US009585524B2

(12) United States Patent
Knapp et al.

(10) Patent No.: US 9,585,524 B2
(45) Date of Patent: Mar. 7, 2017

(54) WALL-ENTRY BATHTUB

(71) Applicant: Kohler Co., Kohler, WI (US)

(72) Inventors: Scott R. Knapp, Sheboygan, WI (US); Santosh R. Narasimhan, Port Washington, WI (US); Jeffrey F. Tempas, Oostburg, WI (US); Kenneth A. Lefeber, Plymouth, WI (US); David P. Ourada, Sheboygan, WI (US); Fred Ogreenc, Cedar Grove, WI (US)

(73) Assignee: KOHLER CO., Kohler, WI (US)

( * ) Notice: Subject to any disclaimer, the term of this patent is extended or adjusted under 35 U.S.C. 154(b) by 235 days.

(21) Appl. No.: 14/508,704

(22) Filed: Oct. 7, 2014

(65) Prior Publication Data

US 2015/0020305 A1 Jan. 22, 2015

Related U.S. Application Data

(63) Continuation of application No. 12/908,322, filed on Oct. 20, 2010, now Pat. No. 8,863,323.

(60) Provisional application No. 61/253,833, filed on Oct. 21, 2009.

(51) Int. Cl.
*A47K 3/02* (2006.01)
*A47K 3/00* (2006.01)

(52) U.S. Cl.
CPC ..... *A47K 3/006* (2013.01); *A47K 3/001* (2013.01); *Y10T 29/49826* (2015.01)

(58) Field of Classification Search
CPC ..... A47K 3/006; A47K 3/022
USPC ..... 4/555, 556
See application file for complete search history.

(56) References Cited

U.S. PATENT DOCUMENTS

| | | | |
|---|---|---|---|
| 998,242 | A | 7/1911 | Gervais |
| 2,037,085 | A | 4/1936 | Naylor |
| 2,804,629 | A | 9/1957 | Ring |
| 3,380,078 | A | 4/1968 | Hanson |
| 3,416,166 | A | 12/1968 | Hanson |
| 3,423,769 | A | 1/1969 | Cowley |
| 3,863,275 | A | 2/1975 | Brendgord et al. |
| 4,099,272 | A | 7/1978 | Sowder |
| 4,258,444 | A | 3/1981 | Orszullok |

(Continued)

FOREIGN PATENT DOCUMENTS

| | | |
|---|---|---|
| DE | 3508713 | 10/1985 |
| GB | 2347856 | 9/2000 |

(Continued)

OTHER PUBLICATIONS

Notification of First Office Action in Chinese Application No. 201080047664.3 mailed Apr. 9, 2014.

(Continued)

*Primary Examiner* — Huyen Le
(74) *Attorney, Agent, or Firm* — Foley & Lardner LLP

(57) ABSTRACT

A wall-entry bathtub includes a basin, a shell defining an entryway to allow access into the basin, and an entry wall movable between a lowered position and a raised position, wherein the entry wall is substantially clear of the entryway in the lowered position and at least partially blocks the entryway in the raised position. The bathtub also includes first and second entry wall position sensors configured to sense the position of the entry wall and a controller in electronic communication with the first and second entry wall position sensors, wherein the controller is configured to control components of the bathtub based at least in part on the position of the entry wall.

30 Claims, 26 Drawing Sheets

(56) References Cited

U.S. PATENT DOCUMENTS

| | | | |
|---|---|---|---|
| 4,346,485 | A | 8/1982 | Reed |
| 4,365,367 | A | 12/1982 | Houle et al. |
| 4,432,104 | A | 2/1984 | Sasaki |
| 4,446,586 | A | 5/1984 | Reed et al. |
| 4,542,545 | A | 9/1985 | Johnson et al. |
| 4,546,506 | A | 10/1985 | Houle et al. |
| 4,563,780 | A | 1/1986 | Pollack |
| 4,796,312 | A | 1/1989 | Corlew |
| 5,163,187 | A | 11/1992 | Dannenberg et al. |
| 5,184,358 | A | 2/1993 | Gruidel et al. |
| 5,220,696 | A | 6/1993 | Dannenberg et al. |
| 5,351,345 | A | 10/1994 | Sills et al. |
| 5,446,929 | A | 9/1995 | Sills et al. |
| 5,701,614 | A | 12/1997 | Appleford et al. |
| 5,898,958 | A | 5/1999 | Hall |
| 5,940,902 | A | 8/1999 | Onge et al. |
| 5,975,124 | A | 11/1999 | Stevens, II |
| 6,055,685 | A | 5/2000 | Norton et al. |
| 6,134,722 | A | 10/2000 | Lowry et al. |
| 6,473,915 | B1 | 11/2002 | Davis et al. |
| 6,735,792 | B2 | 5/2004 | Johansson |
| 6,926,061 | B2 | 8/2005 | Schulte |
| 6,956,486 | B2 | 10/2005 | King, Jr. |
| 7,237,276 | B2 | 7/2007 | Longman |
| 7,240,524 | B1 | 7/2007 | White et al. |
| 7,299,509 | B1 | 11/2007 | Neidich |
| 7,350,245 | B2 | 4/2008 | Giagni |
| 2004/0064883 | A1 | 4/2004 | Appleford et al. |
| 2005/0102746 | A1 | 5/2005 | Wright et al. |
| 2007/0067901 | A1 | 3/2007 | Longman |
| 2008/0276368 | A1 | 11/2008 | Neidich et al. |

FOREIGN PATENT DOCUMENTS

| | | |
|---|---|---|
| JP | 2115424 | 4/1990 |
| JP | 11070053 | 3/1999 |
| JP | 2002364933 | 12/2002 |
| JP | 2005058381 | 3/2005 |
| WO | WO86/03389 | 6/1986 |
| WO | WO02/21987 | 3/2002 |
| WO | WO2008/137554 | 11/2008 |

OTHER PUBLICATIONS

International Preliminary Report on Patentability for International Application No. PCT/US2010/053515; dated Apr. 24, 2012; 13 pages.

Five Pages of ISR from the corresponding PCT/US2010/053515, mailed Feb. 4, 2011.

Aquatic, "Freedomline Series"; Model No. F6032TRO; Aquatic Catalogue; dated Mar. 2010.

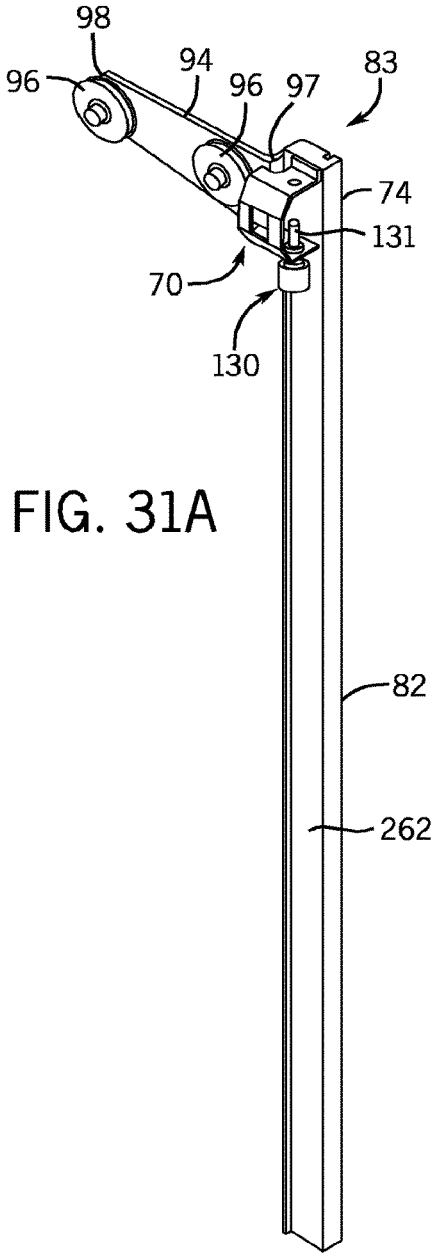
FIG. 31A
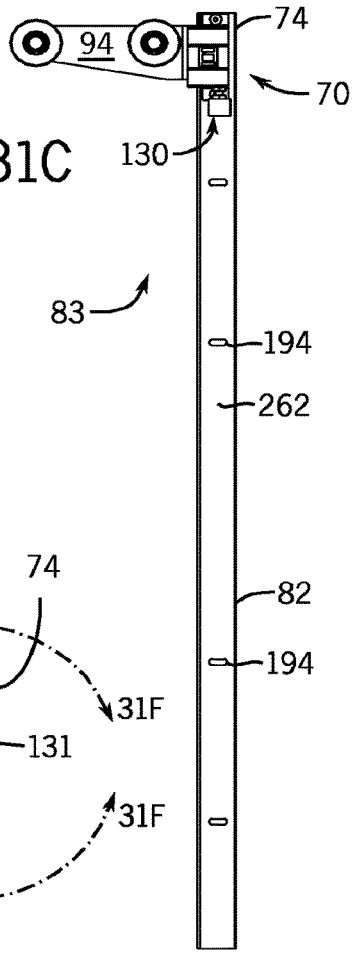
FIG. 31C
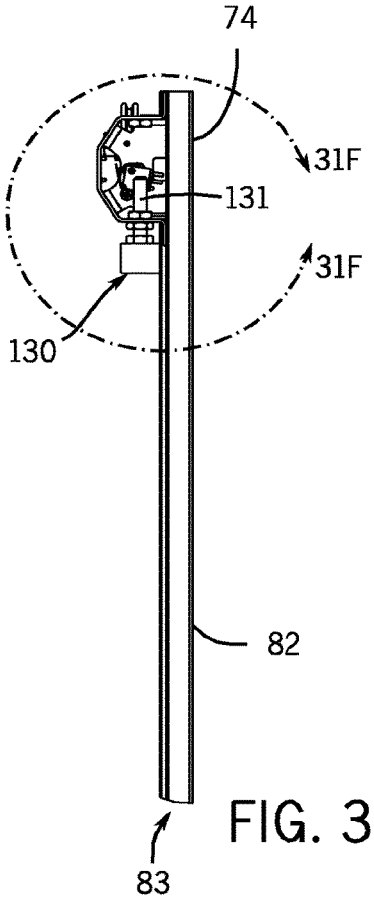
FIG. 31B
FIG. 31D
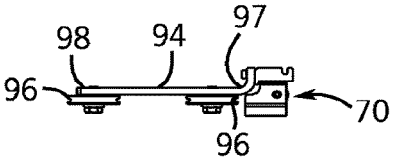

FIG. 32F
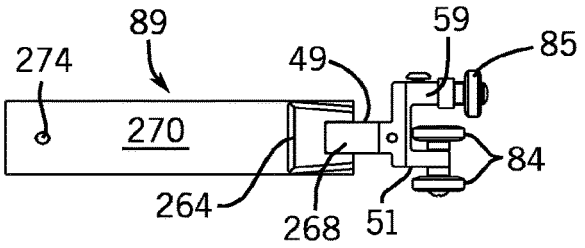
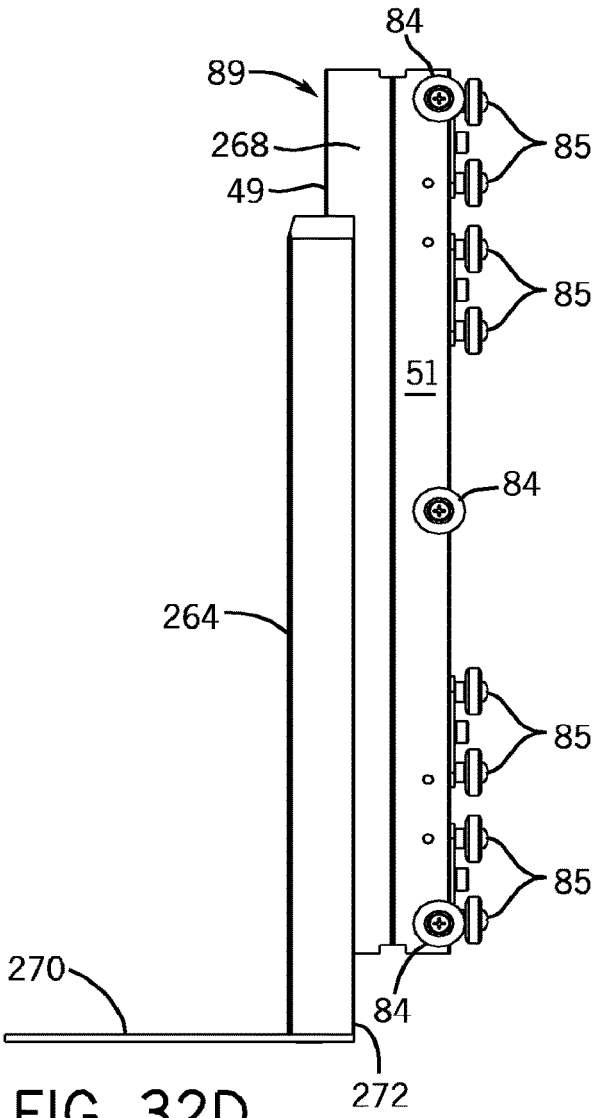
FIG. 32D
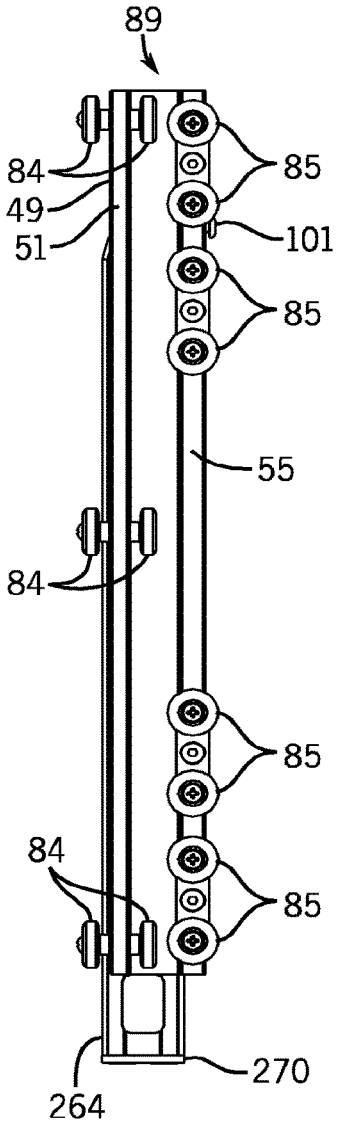
FIG. 32E

WALL-ENTRY BATHTUB

CROSS-REFERENCE TO RELATED PATENT APPLICATIONS

This application is a Continuation of U.S. patent application Ser. No. 12/908,322, filed Oct. 20, 2010 (now U.S. Pat. No. 8,863,323), which claims priority to and the benefit of U.S. Provisional Patent Application No. 61/253,833, filed Oct. 21, 2009. The entire disclosures of U.S. patent application Ser. No. 12/908,322 and U.S. Provisional Patent Application No. 61/253,833 are incorporated by reference as if fully set forth herein.

STATEMENT OF FEDERALLY SPONSORED RESEARCH OR DEVELOPMENT

Not applicable.

BACKGROUND

The present application relates to wall-entry bathtubs, in particular to wall-entry bathtubs incorporating a moveable entry wall and/or improved operational features.

Convenient ingress and egress from a conventional bathtub is of significant concern for those dealing with physical limitations that prevent or complicate use of a conventional, fixed-wall bathtub (e.g., due to age, injury, etc.).

Wall-entry bathtubs are intended to provide improved ease of entry and exit (e.g., ingress and egress) to a bathtub (e.g., by reducing the step-over height required to enter and exit the bathtub.)

These wall-entry bathtubs present unique challenges for those designing and implementing the bathtub, which is often installed in an existing bathroom as a replacement for a conventional, fixed-wall bathtub. For example, bathers using wall-entry bathtubs often remain seated in the wall-entry bathtub until substantially all of the water has drained (e.g., because of physical limitations, to minimize water spillage, etc.). Accordingly, it is desirable to shorten the time it takes to drain or substantially drain water from a bathtub. Further, bathers using wall-entry bathtubs often have limited ability to move and/or seal the entry wall (alternatively, door, etc.). Accordingly, it is desirable to improve the ease of moving and/or sealing the entry wall. Further still, additional devices/features providing functionalities can result in excessive noise. Limiting excessive noise during operation of a wall-entry bathtub can provide an improved user-experience. Further still, improved ease of access may mean there are additional opportunities for water spillage. It is desirable that water spillage be minimized. Further still, designing a reliable and convenient entry wall latch mechanism challenges the practical implementation of a wall-entry bathtub, as actuation of the latch mechanism is preferably a deliberate act by the bather to prevent unintended movement of the entry wall, especially when the bathtub is full. The integration of electronics to control and monitor various features of the bathtub present yet another series of challenges in the design of a wall-entry bathtub, especially when controls are integrated into the moveable entry wall. Further still, the integration and control of the various components and systems for filling, draining, sealing, and monitoring the bathtub present various unique challenges to the design of a wall-entry bathtub, as opposed to a conventional, fixed-wall bathtub.

Accordingly, it would be advantageous to provide a wall-entry bathtub that is practical, reliable, and convenient, especially for those bathers living with any number of physical limitations by decreasing drain time, improving the ease of moving and/or sealing the entry wall, limiting excessive noise during operation, minimizing water spillage, and/or improving controls and/or monitoring associated with the operation of the wall-entry bathtub.

SUMMARY

The present application relates to wall-entry bathtubs incorporating a variety of features that enhance the design, manufacture, installation, and use of the wall-entry bathtub.

According to an exemplary embodiment, a wall-entry bathtub includes a basin, a shell defining an entryway to allow access into the basin, and an entry wall movable between a lowered position and a raised position, wherein the entry wall is substantially clear of the entryway in the lowered position and at least partially blocks the entryway in the raised position. The bathtub also includes first and second entry wall position sensors configured to sense the position of the entry wall and a controller in electronic communication with the first and second entry wall position sensors, wherein the controller is configured to control components of the bathtub based at least in part on the position of the entry wall.

According to another exemplary embodiment, a wall-entry bathtub includes a basin, a shell defining an entryway to provide access into the basin, and an entry wall moveable between a lowered position and a raised position, wherein in the lowered position the entry wall is substantially clear of the entryway, and wherein in the raised position the entry wall at least partially blocks the entryway. The bathtub also includes a seal member disposed generally between the entry wall and the shell, wherein the seal member is configured for inflation when the entry wall is in the raised position, a pressure sensor configured to sense air pressure within the seal member, and a controller in electronic communication with the pressure sensor.

According to another exemplary embodiment, a wall-entry bathtub includes a basin, a shell defining an entryway to provide access into the basin, and an entry wall movable between a lowered position in which the entry wall is substantially clear of the entryway and a raised position in which the entry wall at least partially blocks the entryway. The bathtub also includes a controller configured to control components of the bathtub according to pre-determined logic stored in the controller, first and second entry wall position sensors configured to sense the position of the entry wall, and a seal member disposed generally between the entry wall and the shell, wherein the seal member is configured for inflation when the entry wall is in the raised position. The controller is configured to close a drain valve and inflate the seal member when the first and second entry wall position sensors sense that the entry wall is in the raised position.

In one aspect, a wall-entry bathtub comprises a basin and a shell defining an entryway to provide access into the basin. An entry wall is disposed generally proximate and exterior to the shell and is movable in a plane generally parallel to the entryway between a lowered position and a raised position, wherein in the lowered position the entry wall is substantially clear of the entryway, and wherein in the raised position the entry wall at least partially blocks the entryway. The wall-entry bathtub includes one or more latch members and one or more bracket members configured to be operatively coupled to the one or more latch members when the entry wall is in the raised position to maintain the entry wall in the raised position.

In another aspect, a method of assembling a modular, wall-entry bathtub comprises providing an entry wall, a support frame, and a shell; installing the support frame and the shell in a rough opening; and coupling the entry wall to the support frame.

In a further aspect, a method of operating a wall-entry bathtub comprises providing a shell, an entry wall moveable between a lowered position and a raised position, a basin defined substantially by the shell and the entry wall, a seal member disposed generally between the entry wall and the shell when the entry wall is in the raised position, a first drain, a second drain, and a fill element; actuating the fill element; maintaining the second drain in an open position; moving the entry wall from the lowered position to the raised position; inflating the seal member; and allowing the second drain to be moved from an open position to a closed position.

The foregoing and other aspects will appear from the following description. In that description, reference is made to the accompanying drawings, which form a part hereof, and in which there is shown by way of illustration preferred, example embodiments. These example embodiments do not represent the full scope of the application.

BRIEF DESCRIPTION OF THE DRAWINGS

FIG. 31A is an isometric view of an example track assembly;

FIG. 31B is a partial front view of the example track assembly shown in FIG. 31A;

FIG. 31C is a side plan view of the example track assembly shown in FIG. 31A;

FIG. 31D is a top plan view of the example track assembly shown in FIG. 31A;

FIG. 32D is a front plan view of the example roller assembly shown in FIG. 32A;

FIG. 32E is a side plan view of the example roller assembly shown in FIG. 32A;

FIG. 32F is a top plan view of the example roller assembly shown in FIG. 32 A.

DETAILED DESCRIPTION

Figure 1:
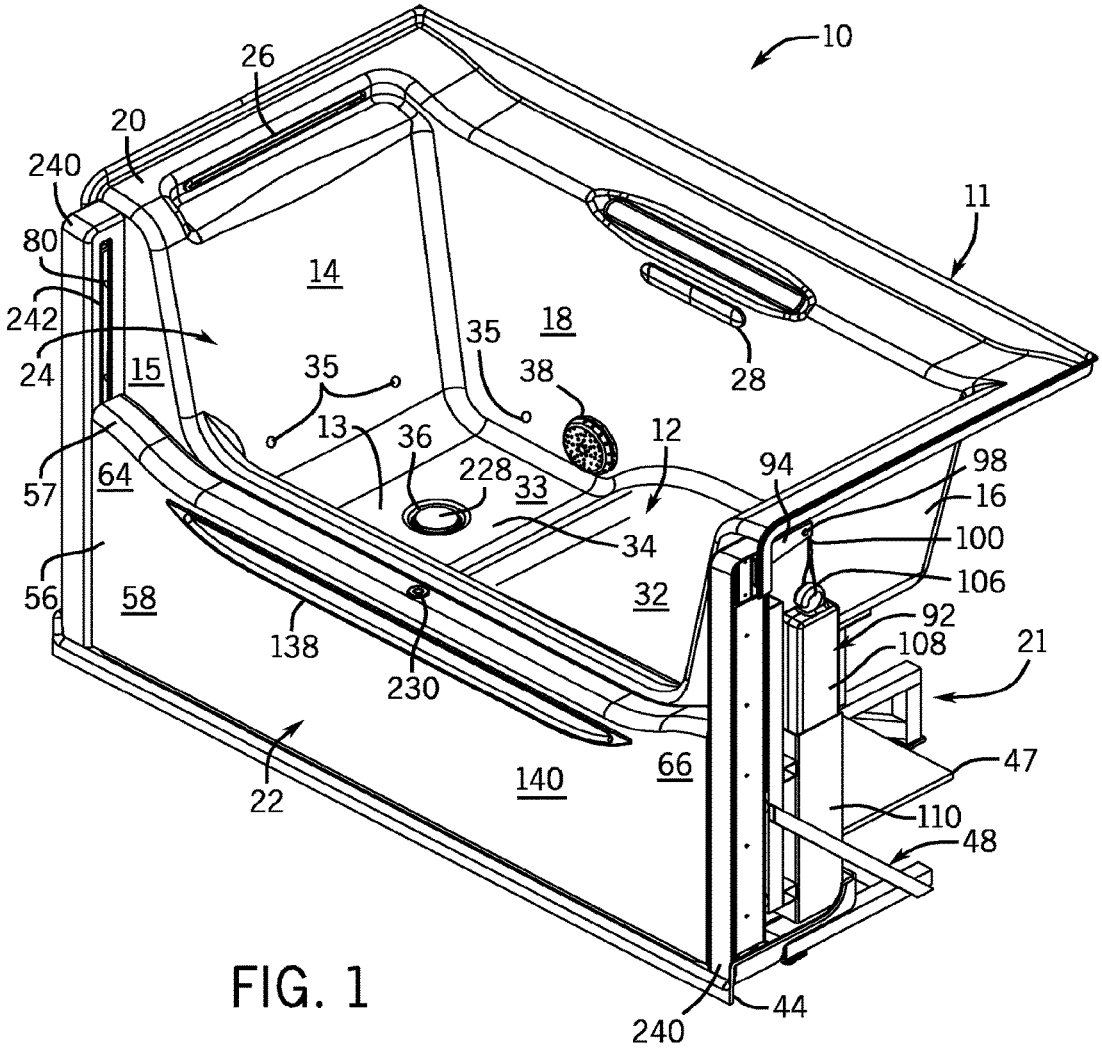
FIG. 1 is a front, side isometric view of an example wall-entry bathtub showing an example entry wall in the lowered position.
Figure 2:
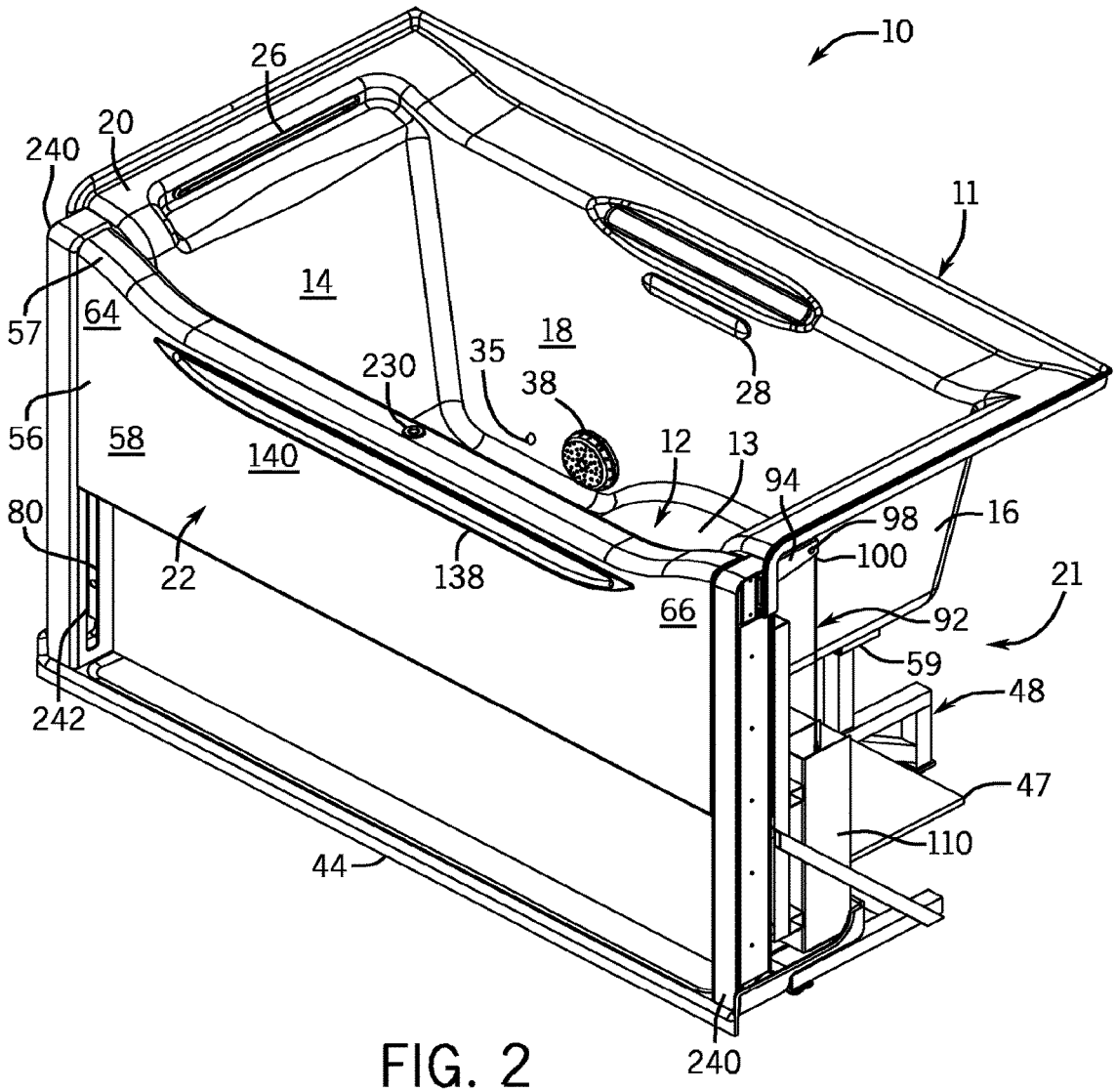
FIG. 2 is a front, side isometric view of the wall-entry bathtub showing the entry wall in the raised position.

Referring to FIGS. 1 and 2, a wall-entry bathtub 10 is shown according to an example embodiment. The wall-entry bathtub 10 includes a base 21 and an entry wall 22 moveable relative to the base 21. While the wall-entry bathtub 10 is shown to be substantially rectangular, it should also be noted that, a wall-entry bathtub in accordance with this disclosure may have various form factors (e.g., as viewed from above, the side, etc.), such as generally oval, round, rectangular, triangular, polygonal, irregular, etc.

The base 21 is shown including a shell 11 having a bottom wall 13, a pair of sidewalls including a first side wall 14 and a second side wall 16, a rear wall 18, and a front wall 15. The sidewalls 14,16, the rear wall 18, and the seal or front wall 15 extend generally upwards, away from the bottom wall 13 to at least partially define a basin 12. The shell 11 is preferably made of conventional materials and techniques, which are known to one of ordinary skill in the art, and may be of any form factor accommodating an entry wall 22. It should be noted that the seal wall need not be a front wall, but may be a front facing surface of a side wall, or other suitable wall/surface for sealing the entry wall 22 to the base 21, as will be discussed in more detail below.

The entry wall 22 is configured to be moved between a lowered position (see e.g., FIG. 1) and a raised position (see e.g., FIG. 2). In the lowered position, the entry wall 22 is substantially clear of (e.g., substantially does not obstruct, block, close off, etc.) an entryway 24 defined by the front wall 15 of the shell 11. The entryway 24 is intended to provide a bather access to the basin 12. Accordingly, the bather is intended to enter and exit the wall-entry bathtub 10 when the entry wall 22 is in the lowered position. In the raised position, the entry wall 22 at least partially blocks (e.g., obstructs, closes off, etc.) the entryway 24. In the raised position, the entry wall 22 helps define the basin 12 and, thereby, helps provide for the water level in the wall-entry bathtub 10 to be filled to a level greater (i.e., higher, etc.) than the level to which it can be filled when the entry wall 22 is in the lowered position.

Referring further to FIGS. 1 and 2, the entry wall 22 is slidably mounted so that it is movable relative to the base 21. When moving between the lowered position and the raised position, the entry wall 22 moves in a plane generally parallel to the front wall 15, here, in a direction that is substantially vertical. The entry wall 22 is shown disposed generally proximate and exterior to the front wall 15 of the shell 11. As will be discussed in more detail below, a first side of the entry wall is slidably mounted proximate to the first side wall 14 of the shell 11, and the second side of the entry wall 22 is shown slidably mounted proximate to the second side wall 16 of the shell 11 (see e.g., FIGS. 5-8). While the entry wall 22 is shown disposed proximate to the front wall 15, it should be noted that the entry wall and/or entryway may be otherwise located (e.g., at/proximate to a sidewall, etc.). It should also be noted that the plane of the front wall may be other than substantially vertical. Further, the front wall and/or the entry wall may be other than substantially planar (e.g., may include one or more curved portions, etc.).

A rim 20 at least partially surrounds the basin 12. In the example embodiment shown, the rim 20 is defined in part by upper surfaces of the first side wall 14, the second side wall 16, the rear wall 18, and the front wall 15. When in the raised position, an upper surface of the entry wall 22 also forms a part of rim 20. Of course, the side walls 14, 16 and rear wall 18, for example, may be of different heights defining a rim 20 that is generally non-planar. Further, other than a top surface of one or more walls may help define a rim. For example, the rear wall may include a ledge a distance below its top surface that helps define the rim.

Referring to FIGS. 1-4, the wall-entry bathtub 10 further includes an integral fill 26, shown as a substantially rectangular opening formed near the top of the first side wall 14. The integral fill is coupled to a water supply (not shown) and configured to provide for entry of water into basin 12 (e.g., filling the wall-entry bathtub 10). The substantially rectangular opening is intended to provide for a "sheet flow"; though, openings of any suitable size and shape for providing for entry of water to the basin 12 may be used. According to some example embodiments, a conventional faucet may be used in lieu of or in addition to an integral fill. The integral fill 26 also includes a drain 31 (shown in FIG. 4) to drain otherwise stagnant water remaining in a reservoir 29 (e.g., after the supply water has been shut off). The integral fill 26 may be coupled to an electrical supply valve 27 (shown schematically in FIG. 19) that is capable of controlling the temperature and flow of water from the integral fill 26. However, an electrical supply valve 27 is not necessary and other types and styles of tub fillers capable of controlling the flow of water into the wall-entry bathtub 10 may be used, including, but not limited to, manually adjustable and operable valves.

An overflow 28 is shown coupled to the rear wall 18 below the rim 20 and is in fluid communication with a primary drain line 30. In addition, the wall-entry bathtub 10 may be configured with a variety of other features, such as bubble massage, whirlpool jets, chromotherapy lights, etc.

Referring further to FIGS. 1-4, the bottom wall 13 is contoured to define a first portion 32 and a second portion 34. The first portion 32 is preferably contoured to provide a seating area for a bather and is located at a height generally greater than the height at which the second portion 34 is located. The second portion 34, typically configured for receiving a bather's feet, establishes a sunken portion 33 (e.g., foot well) of the basin 12 disposed generally lower than the first portion 32 of the bottom wall 13. The sunken portion 33 of the basin 12 has a volume that can be at least partially filled while adjusting the water temperature. Further, the sunken portion 33 prevents water from flowing out of the entryway 24 (in cooperation with the front wall 15 in the example embodiment shown) when the entry wall 22 is in the lowered position.

According to an example embodiment, one or more basin water level sensors 35 are located in or near the sunken portion 33 of the basin 12. The basin water level sensors 35 are configured to detect when water in the second portion 34 has exceeded a predetermined level within the basin 12. When the optional electrical supply valve 27 is incorporated into the wall-entry bathtub 10, the supply of water to the wall-entry bathtub 10 may be shut off in response to the water level meeting or exceeding the predetermined level, as further described below.

Figure 3:
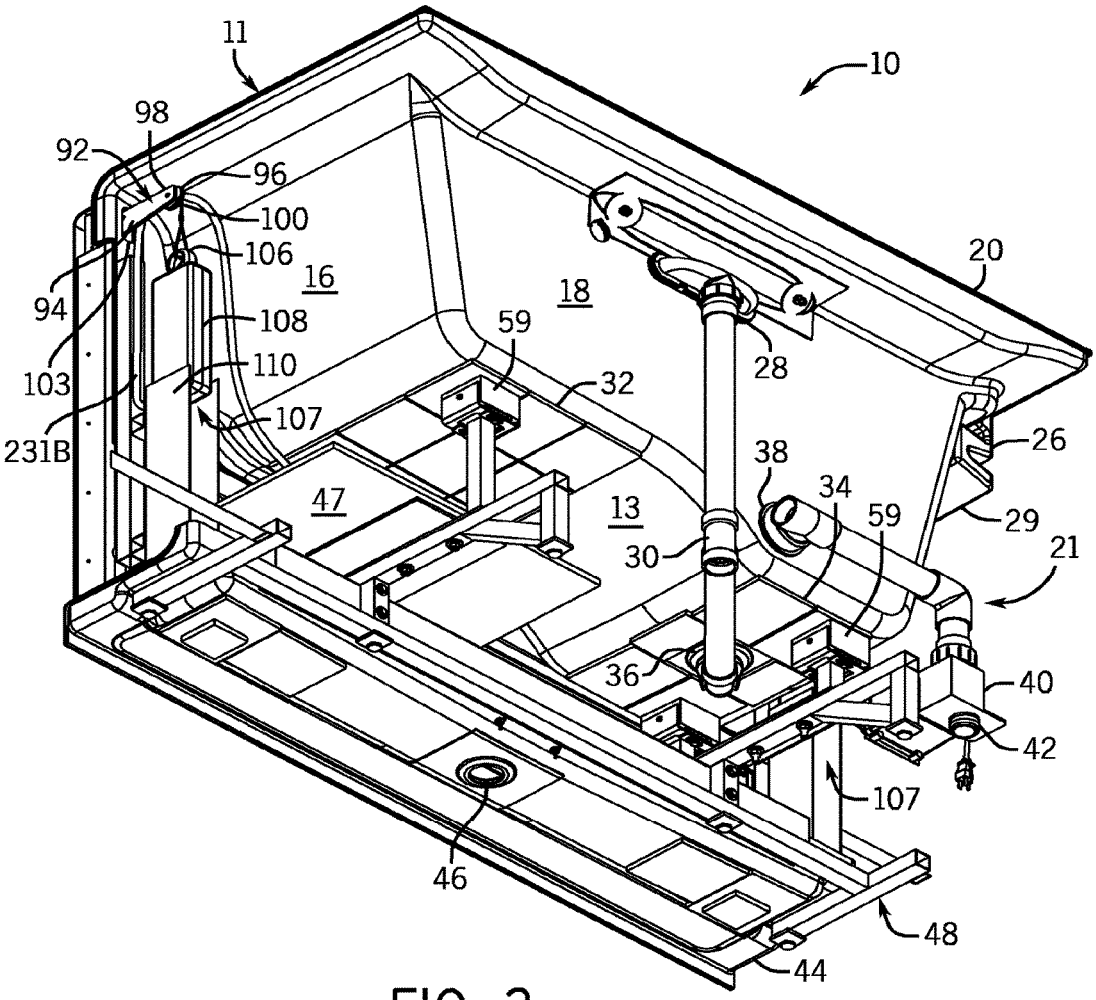
FIG. 3 is a rear, side isometric view of the wall-entry bathtub.
Figure 4:
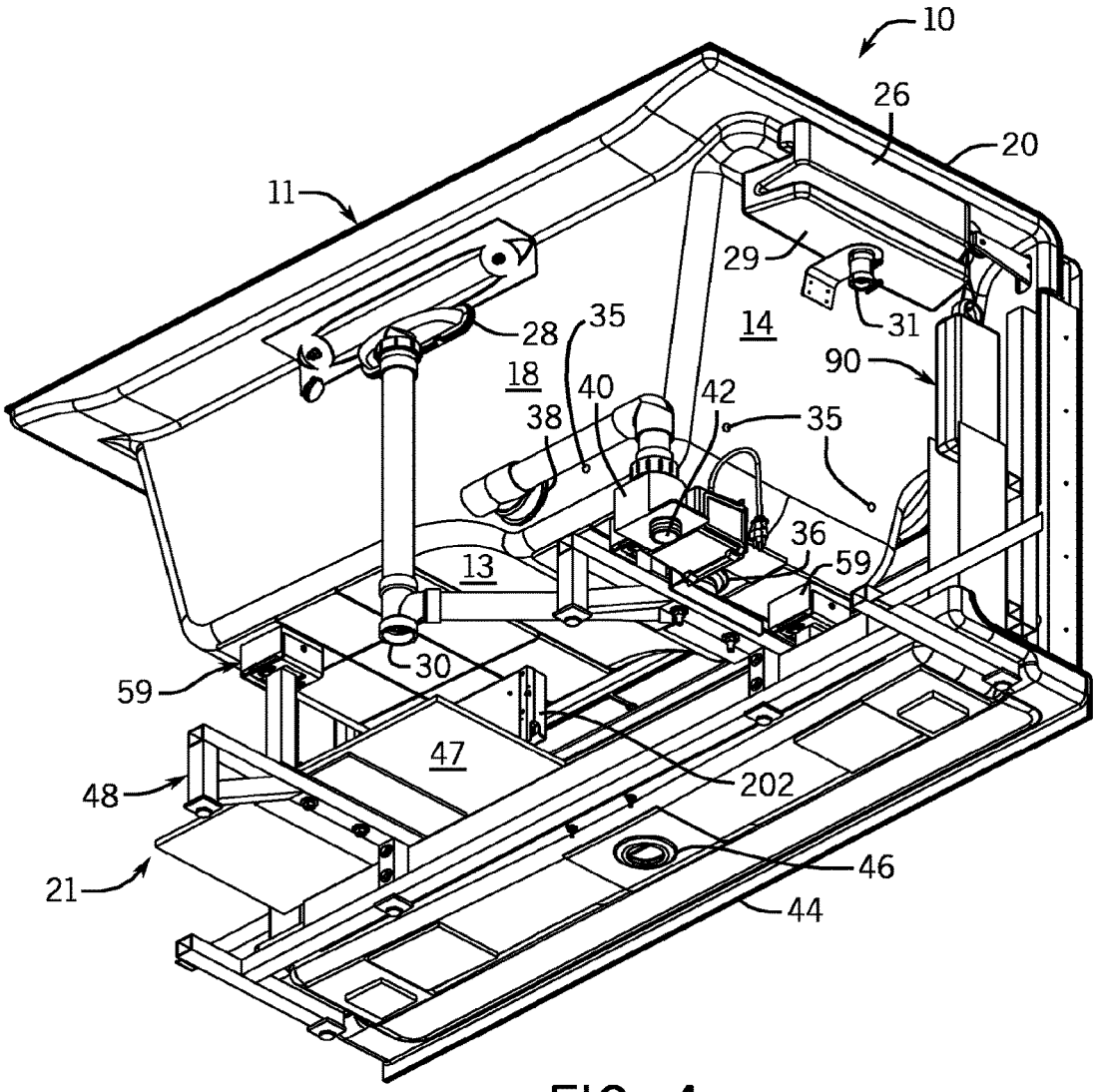
FIG. 4 is an alternative rear, side isometric view of the wall-entry bathtub.
Figure 5:
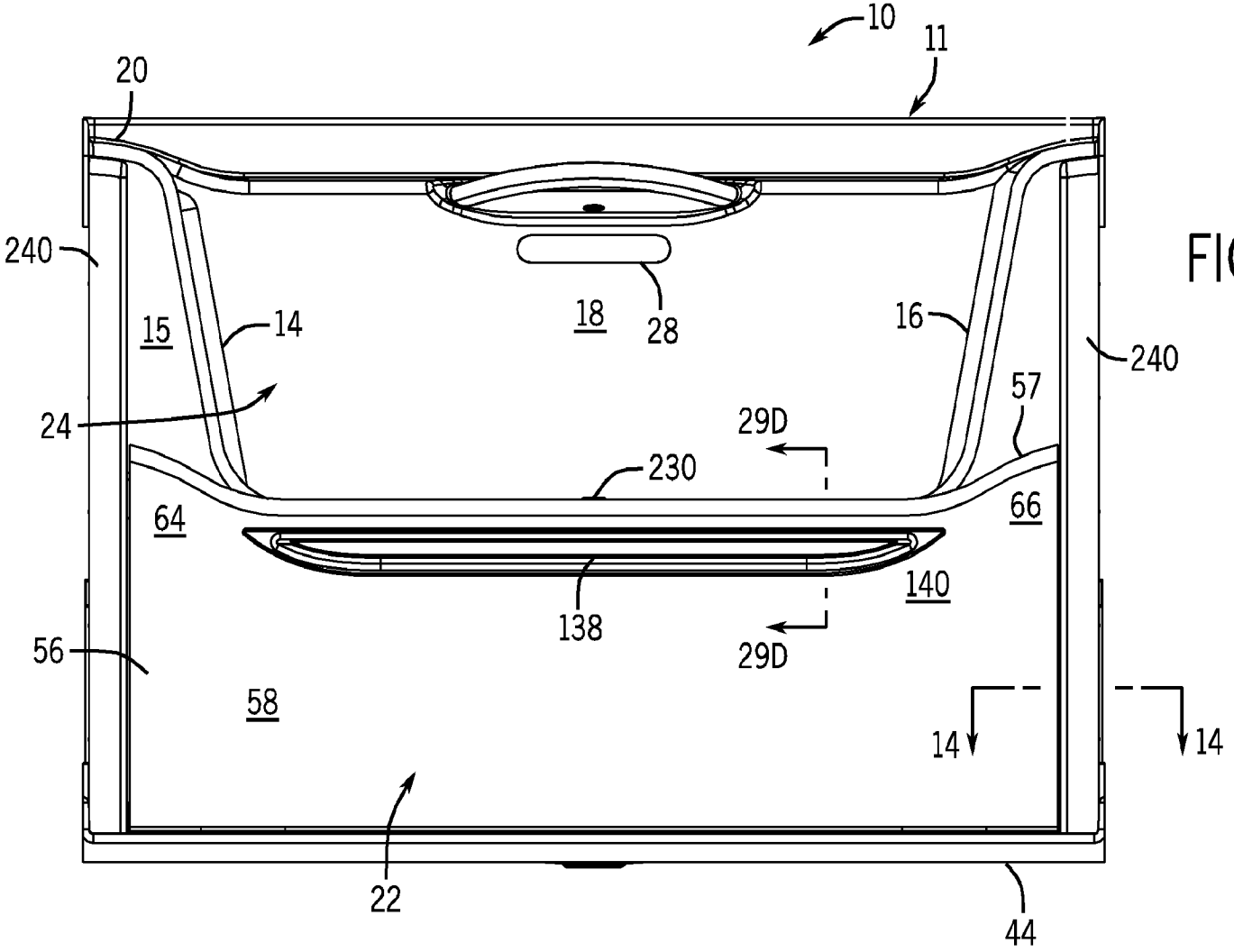
FIG. 5 is a front plan view of the wall-entry bathtub with the entry wall in the lowered position.
Figure 6:
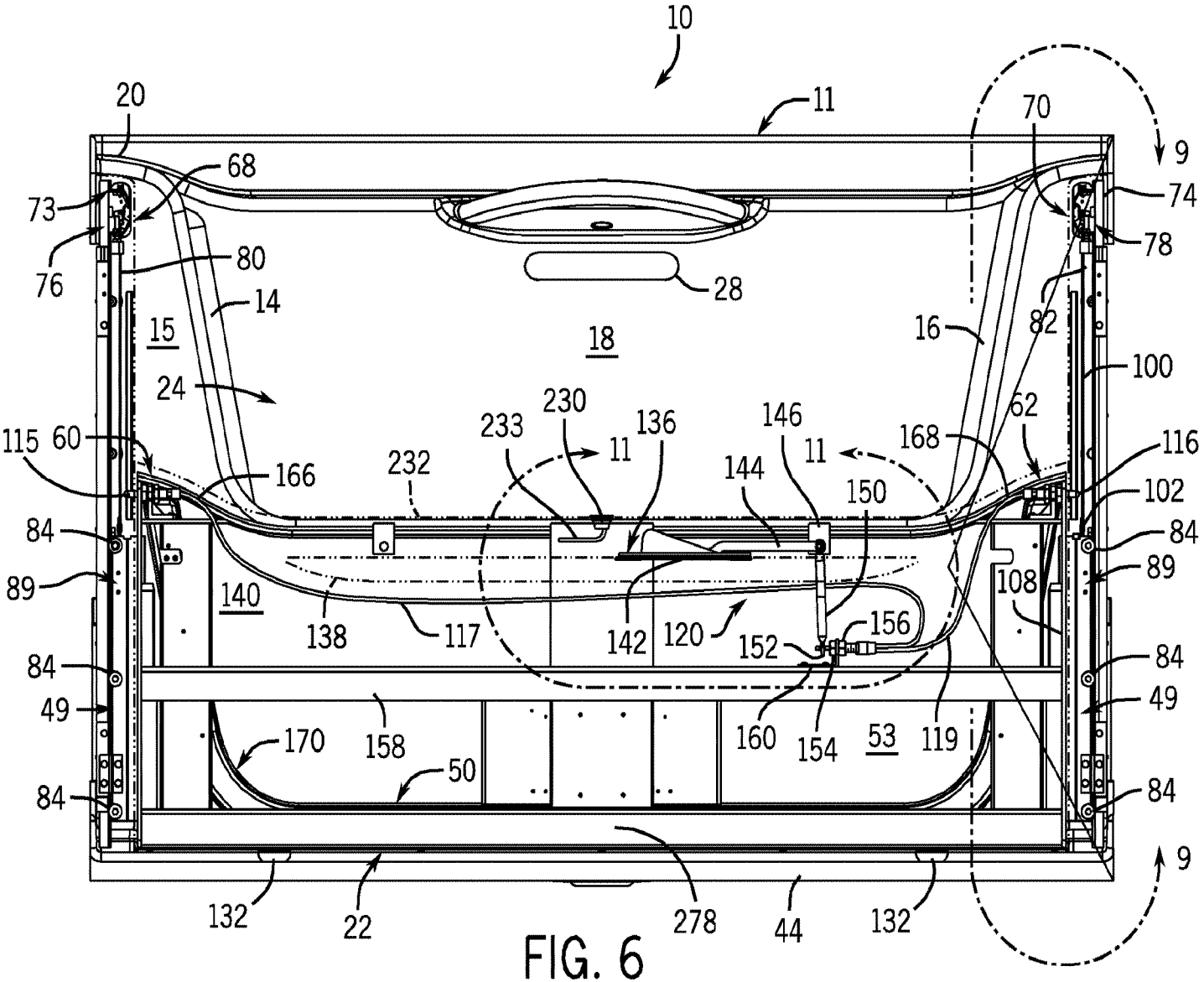
FIG. 6 is a front plan view of the wall-entry bathtub shown in FIG. 5 with a portion of the entry wall removed.
Figure 7:
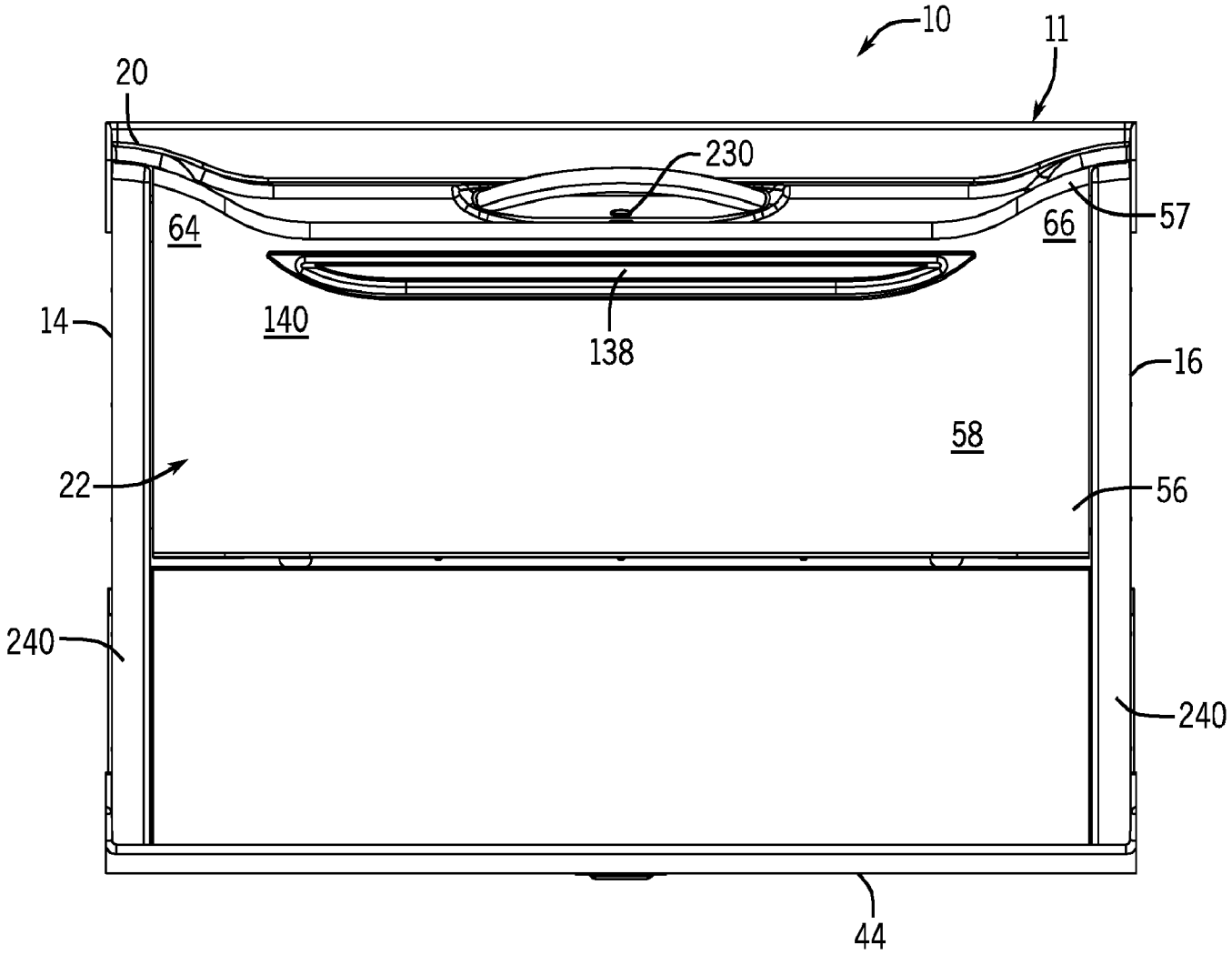
FIG. 7 is a front plan view of the wall-entry bathtub with the entry wall in the raised position.
Figure 8:
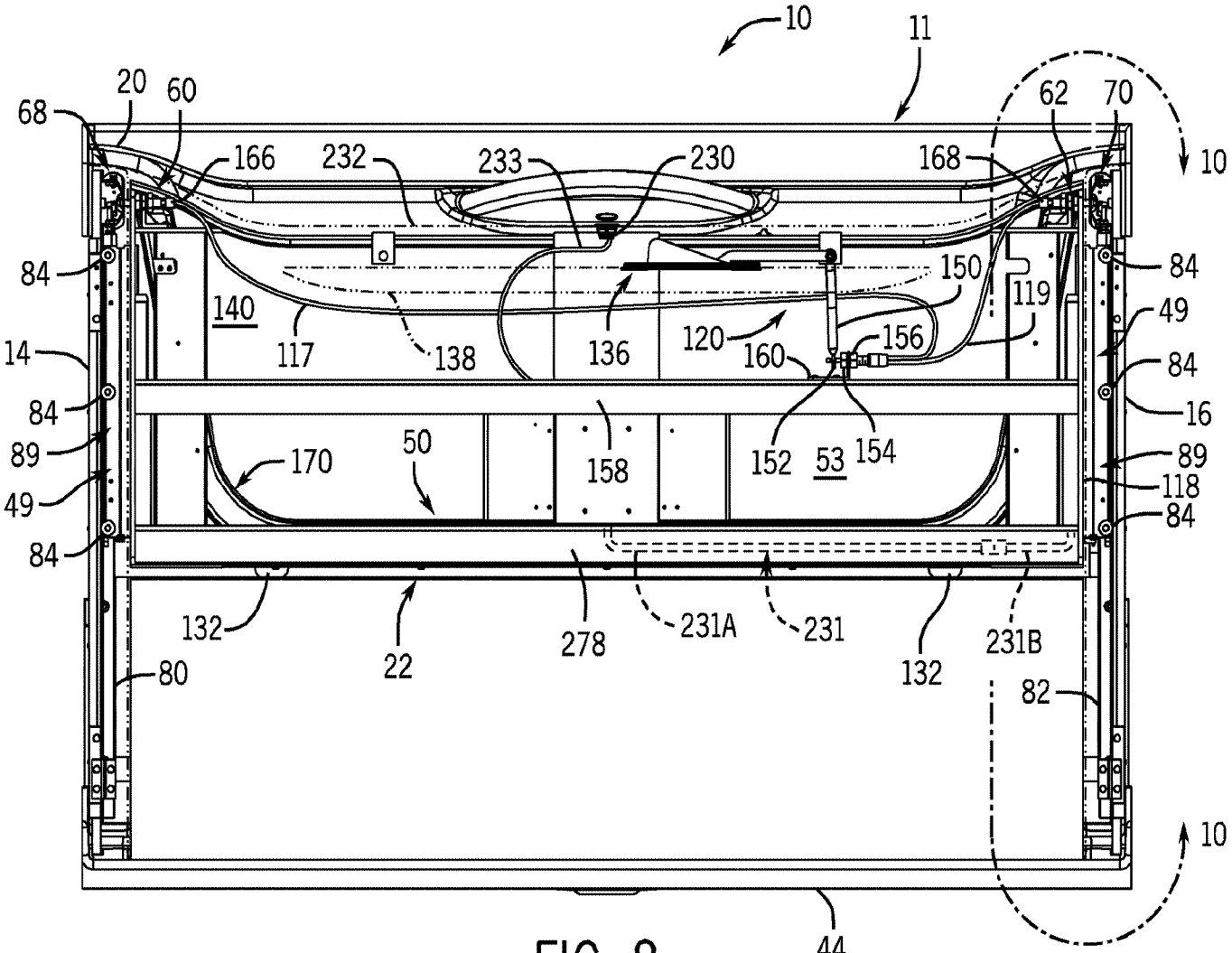
FIG. 8 is a front plan view of the wall-entry bathtub shown in FIG. 7 with a portion of the entry wall removed.
Figure 9:
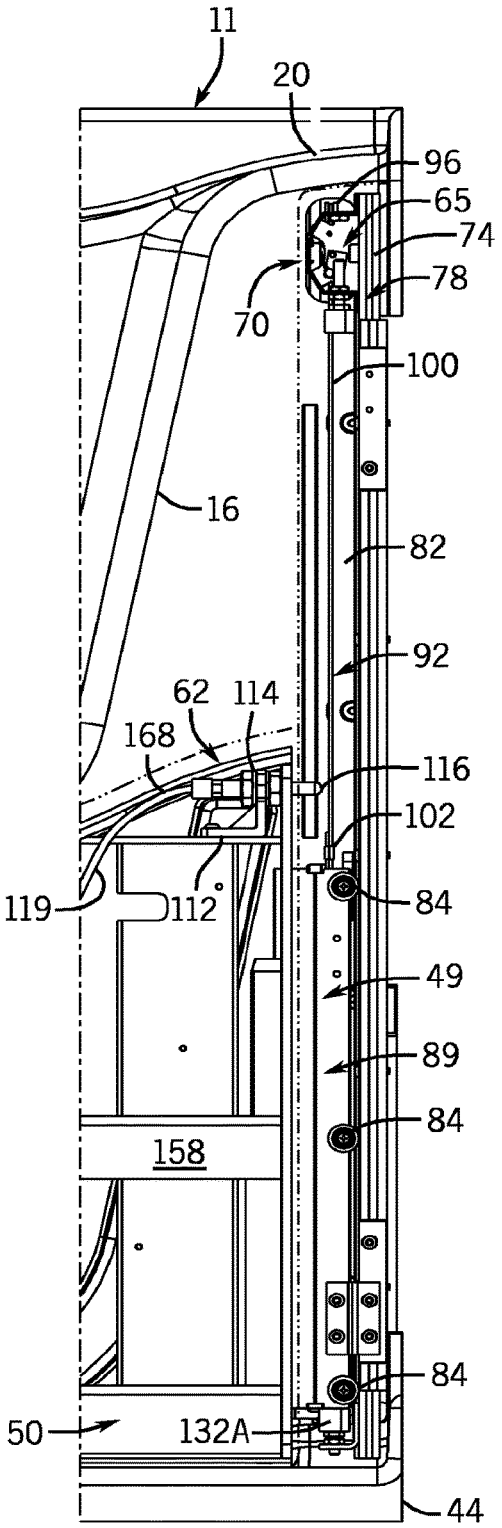
FIG. 9 is a partial view of the area circumscribed by line 9-9 shown in FIG. 6.
Figure 10:
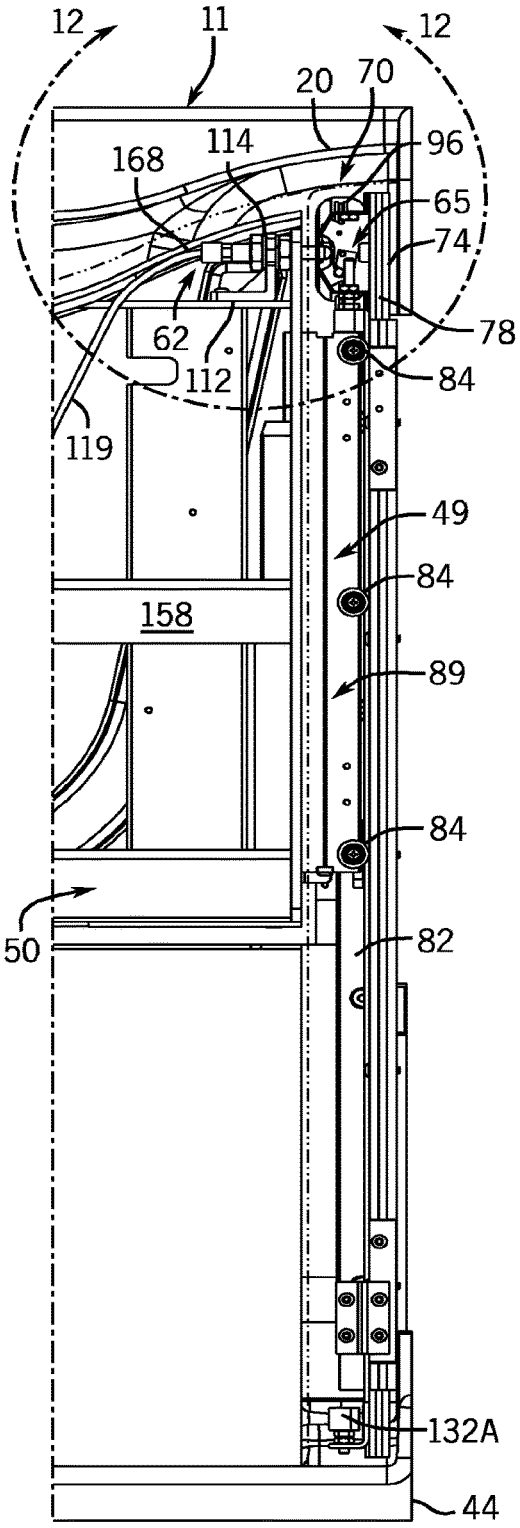
FIG. 10 is a partial view of the area circumscribed by line 10-10 shown in FIG. 8.
Figure 11:
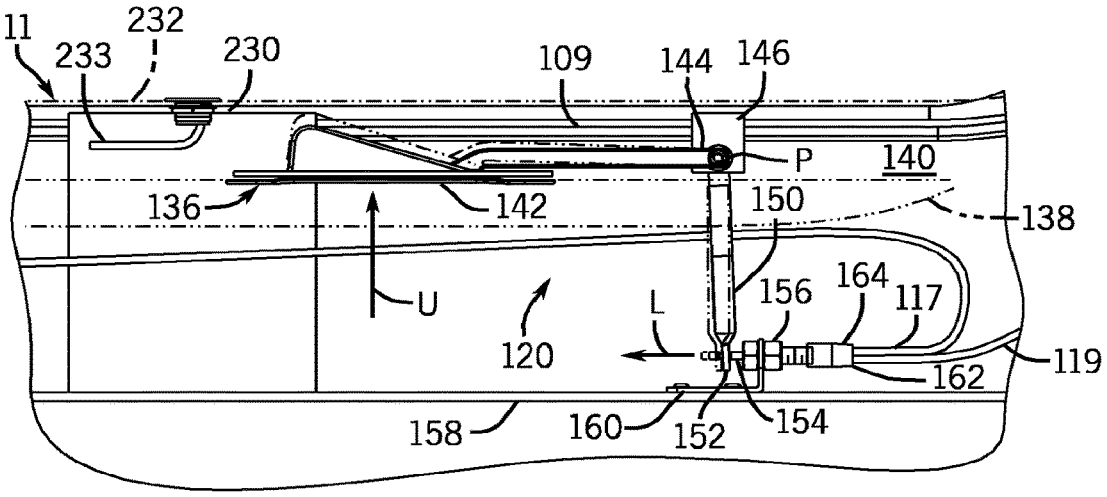
FIG. 11 is a partial view of the area circumscribed by line 11-11 shown in FIG. 6 illustrating a portion of an example handle assembly.

Referring further to FIGS. 1-4, a first drain 36 is positioned in the second portion 34 of the bottom wall 13 and is manually operated to move the first drain 36 between an opened position and a closed position according to an exemplary embodiment. For example, a bather may "tap" the first drain 36 with their toe or foot (which is intended to be positioned in the sunken portion 33, where the first drain 36 is located) to move the first drain 36 between the opened position and the closed position. The first drain 36 can be substantially any type of drain, such as a two-position, spring-loaded type, or a more conventional lever actuated-type, as will be appreciated by one skilled in the art. As shown in FIGS. 3 and 4, the first drain 36 is in fluid communication with the primary drain line 30.

A second drain 38 is positioned in the shell 11 proximate to the second portion 34 of the bottom wall 13 according to an exemplary embodiment. The second drain 38 preferably incorporates an electrical drain valve 40 that is normally open. An outlet 42 of the drain valve 40 is preferably in fluid communication with a secondary drain line (not shown), allowing the first drain 36 and the second drain 38 to provide for a substantial amount of water to flow out of the basin 12 of the wall-entry bathtub 10 in a short amount of time (e.g., in one possible configuration, the first drain 36 and the second drain 38 will allow upwards of sixty gallons of water to be emptied from the wall-entry bathtub 10 in approximately two minutes or less). In the example embodiment described, the first drain 36 and the second drain 38 are gravity drains. According to an alternative embodiment, the second drain 38 and/or the drain valve 40, may be excluded from the wall-entry bathtub 10, thereby reducing the complexity and cost of the complete wall-entry bathtub 10.

Referring in particular to FIGS. 3-4, the wall-entry bathtub 10 further includes a drip tray 44 positioned beneath the entry wall 22 and beneath a portion of the bottom wall 13 to collect residual water (e.g., water splashed over the entry wall 22 during use, water dripped by a bather during egress, etc.) according to an exemplary embodiment. The drip tray 44 is contoured to direct water that is on the drip tray 44 toward a third or central drain 46, which is in fluid communication with a drain line different from the drain line in communication with the first drain 36 and the second drain 38. According to other exemplary embodiments, the third drain may have any suitable configuration and/or connection to a plumbing system suitable for removing water from the drip tray. Further, other features in lieu of or in addition to the drip tray may be used to collect residual water according to still other exemplary embodiments. As one skilled in the art will appreciate, the various drains described herein may be operationally coupled to a conventional sewer system (e.g., a public sewer system, a private sewer system, etc.).

Referring back to FIGS. 1-4, the wall-entry bathtub 10 further includes a support frame 48 according to an exemplary embodiment. The support frame 48 is configured to help elevate the basin 12 relative to a floor (if desired) and to help mount the entry wall 22, as will be discussed in more detail below. It should be noted that it is preferred that the basin be elevated to improve the ease with which a bather is seated on the first portion 32 of bottom wall 13, adjusts the water temperature, positions his or her legs into the sunken portion 33 of the basin 12 (which generally corresponds to the second portion 34 of the bottom wall), and moves the entry wall 22. The example support frame 48 is shown constructed of metal tubing (e.g., square or rectangular) that may be constructed (e.g., welded and bolted) to establish the desired structure, which may vary, for example, depending upon the size of the wall-entry bathtub 10 and other installation variables. However, as will be appreciated by one skilled in the art, the frame 48 may be constructed from wood, plastic, composites, or any other suitable material (or combination of materials) and by any suitable process, such as by welding, screwing, or resin transfer molding.

A plurality of mounts 59 are positioned between the top of the frame 48 and the bottom wall 13 to support the shell 11. The mounts 59 may be made of a semi-rigid, elastomeric material, or may be made of any other suitable material and construction. The frame 48 also includes a platform 47 upon which a controller 202 (e.g., a programmable logic controller) may be mounted (see e.g., FIG. 4).

Referring to FIGS. 5-19 and 29A-32F, the construction and operation of the entry wall 22 will now be discussed in more detail.

The entry wall 22 includes an inner frame 50 housed in a cavity 53 defined between an interior wall 52 generally opposite and spaced a distance from an exterior wall 56 according to an example embodiment. The interior wall 52 includes an interior surface 54 (shown facing rear wall 18). The exterior wall 56 includes an exterior surface 58 (shown facing away from the rear wall 18). A top cap 57 of the example embodiment is integral with the exterior wall 56 and is preferably contoured to provide an armrest for the bather. The top cap 57 may also be a separate component that bridges between the interior wall 52 and the exterior wall 56. In one example embodiment, the inner frame 50 includes aluminum tubing; however, plastic, composites, or any other suitable material may be used to construct the inner frame 50 in whole or in part.

Figures 29A, 29B:
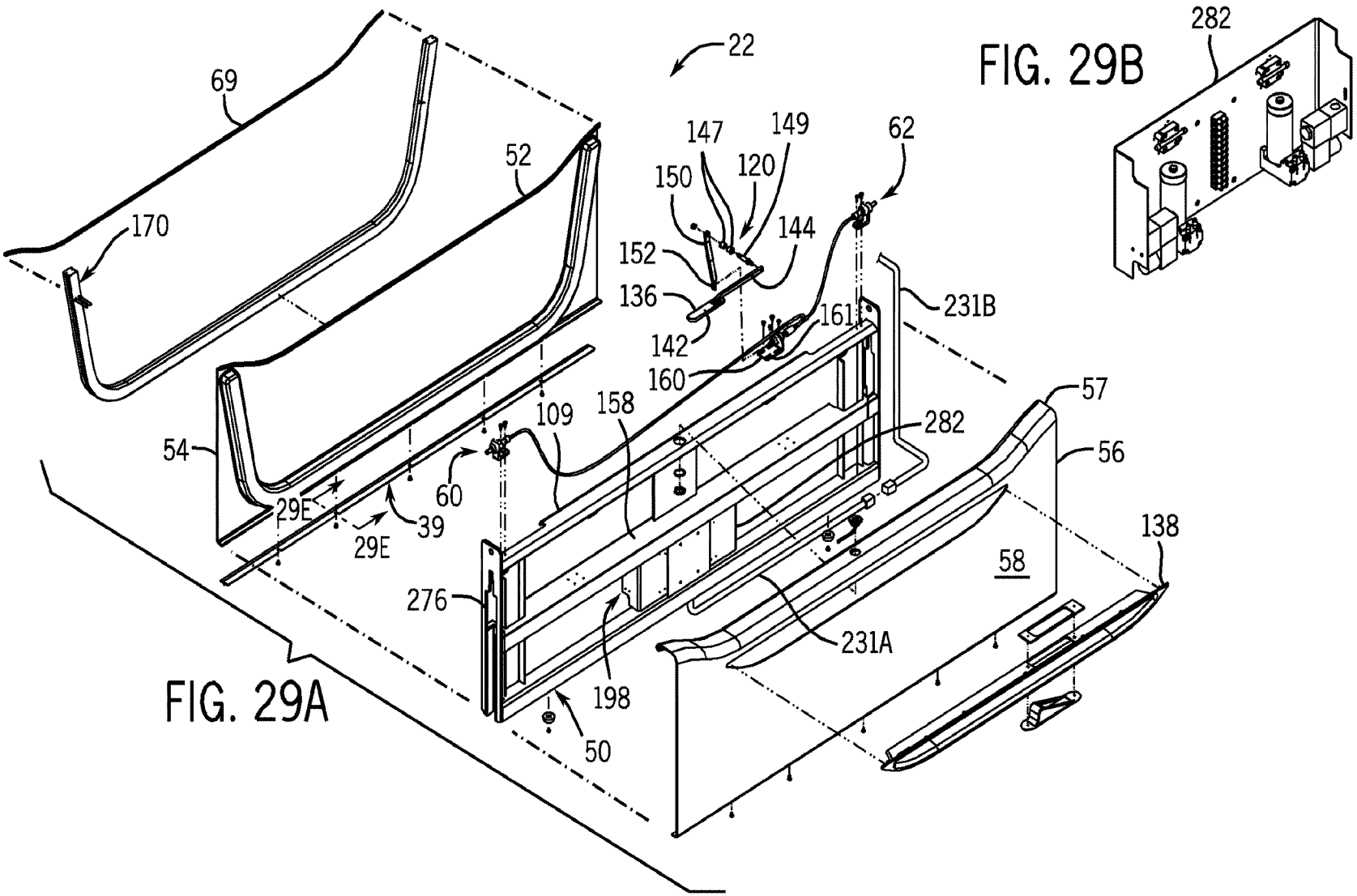
FIG. 29A is an isometric, exploded view of an example entry wall.
FIG. 29B is an isometric view of an example assembly of components.
Figure 29D:
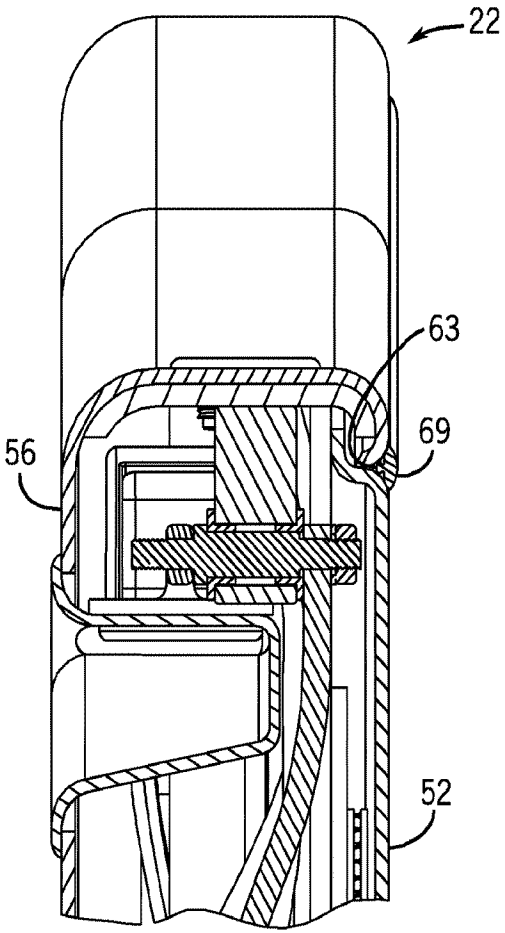
FIG. 29D is a partial section view along line 290-290 shown in FIG. 5.

With specific reference to FIG. 29D, the interface between the interior wall 52 and the exterior wall 56 in the example embodiment defines a groove 63 into which a strip 69, shown having a generally T-shaped cross-section, is seated. The strip 69 is preferably manufactured from extruded polyvinylchloride ("PVC") and secured in the groove 63 by a bead of silicone sealant placed into the groove 63 prior to the strip 69. The strip 69 provides a desirable transition between the interior wall 52 and the exterior wall 56. According to other example embodiments, other materials suitable for improving the interface or securing the strip may be used.

Figure 29C:
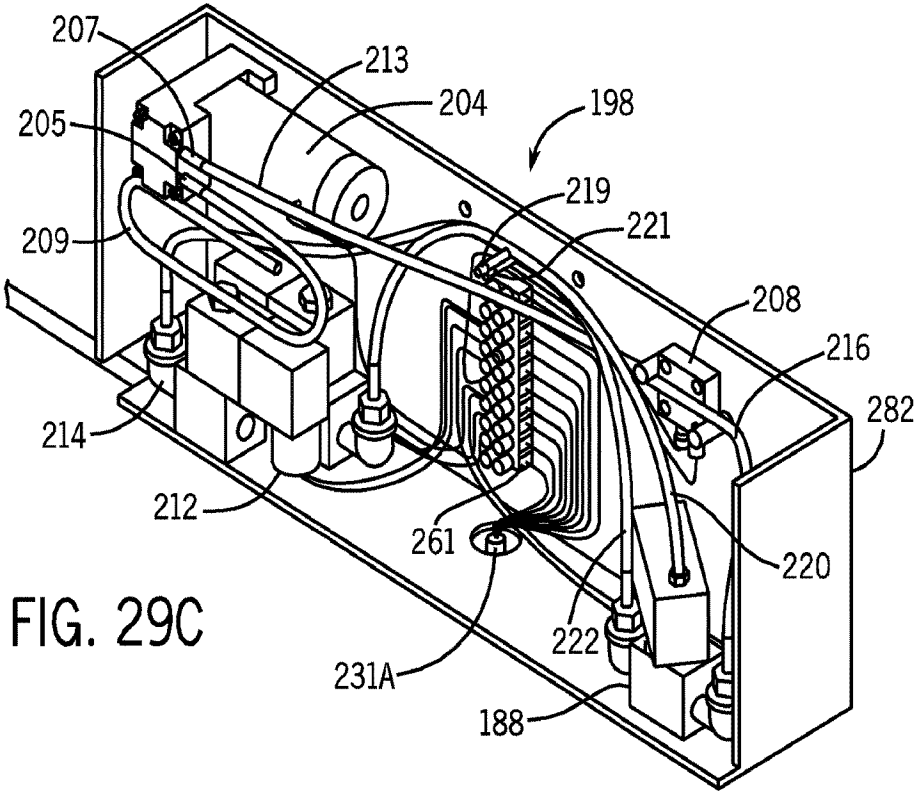
FIG. 29C is an isometric view of an another example assembly of components.
Figure 29E:
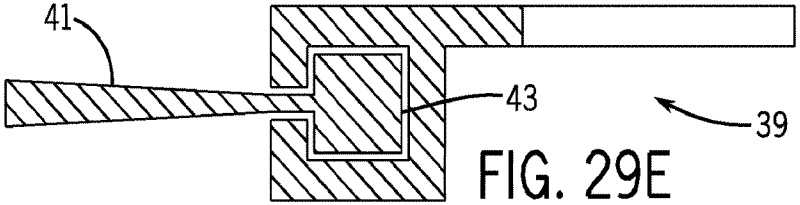
FIG. 29E is a section view along line 29E-29E shown in FIG. 29A.
Figure 30D:
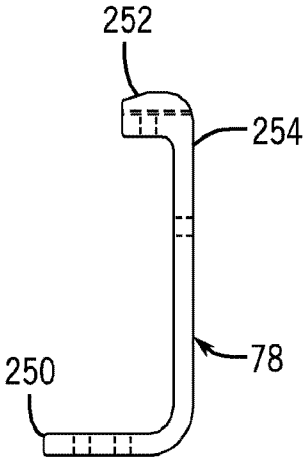
FIG. 30D is a top plan view of the example mounting bracket shown in FIG. 30A.
Figure 30A:
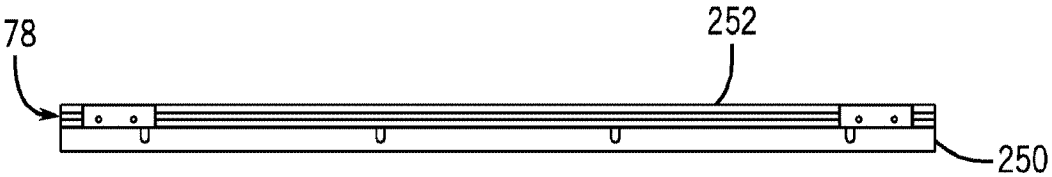
FIG. 30A is a front plan view of an example mounting bracket.
Figure 30B:
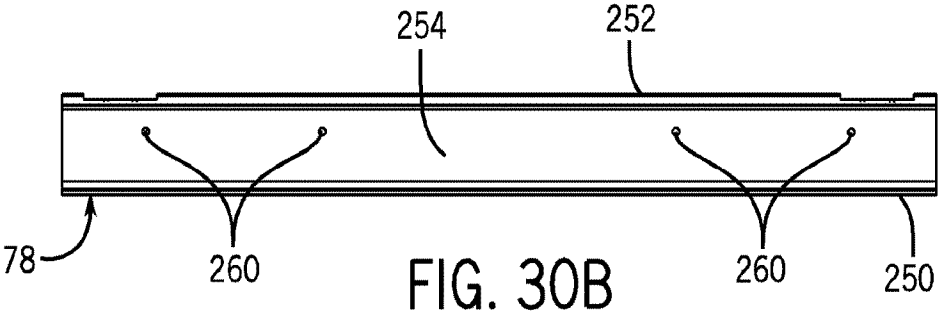
FIG. 30B is a side plan view of the example mounting bracket shown in FIG. 30A.
Figure 30C:
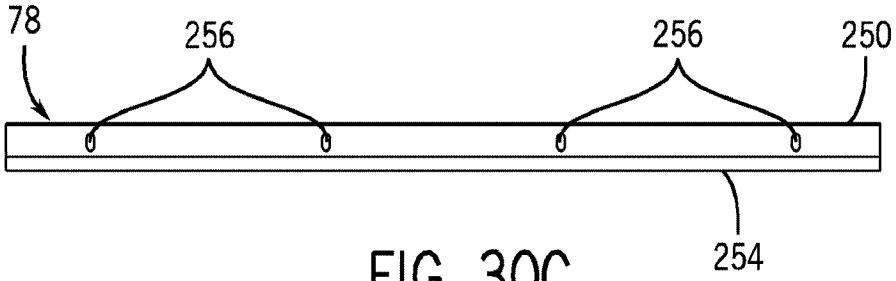
FIG. 30C is a rear plan view of the example mounting bracket shown in FIG. 30A.
Figure 31E:
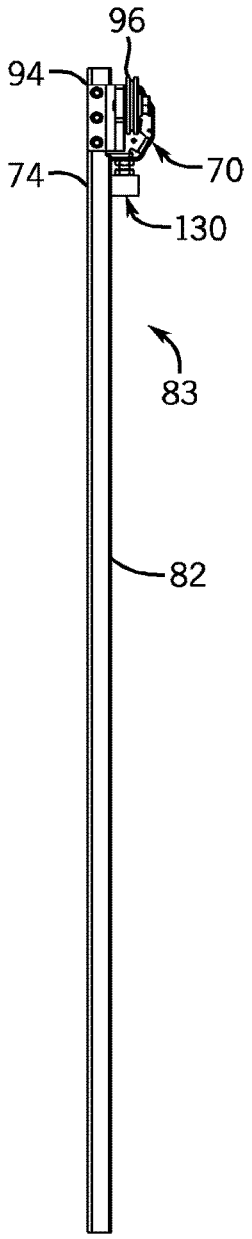
FIG. 31E is a rear plan view of the example track assembly shown in FIG. 31A.
Figure 31F:
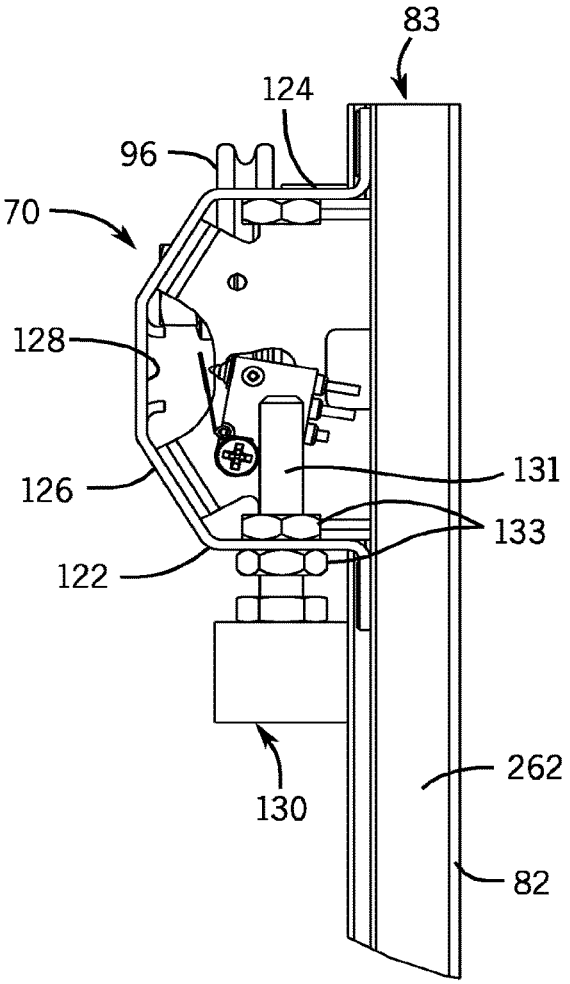
FIG. 31F is a partial front view of the portion of the example track assembly shown in FIG. 31A circumscribed by arc 31F-31F.

With specific reference to FIGS. 29A and 29E, the entry wall 22 further includes a protrusion 39 having a resilient lip 41 that is shown extending from the bottom of the entry wall 22 toward the entryway 24. The protrusion 39 is secured near the bottom of the entry wall 22 such that as the entry wall 22 is lowered, residual water in the wall-entry bathtub 10 is inhibited from falling directly onto the drip tray 44, thereby helping to retain most of the residual water in the drip tray 44 (e.g., by preventing the water from splashing out of the drip tray). In the example shown, the protrusion 39 is preferably an extruded aluminum member having a b-shaped cross-section. The resilient lip 41 is configured to be received (e.g., slid into and captured by) a channel 43 formed by the protrusion 39. In the example embodiment, the resilient lip 41 is a brush-type member including a plurality of bristles. In other forms, the resilient lip 41 may be a single longitudinal member made of rubber or other resilient material.

As discussed above, the entry wall 22 is moveable between a raised position, at which the entry wall 22 at least partially blocks the entryway 24, and a lowered position, at which the entry wall 22 is spaced apart from or substantially clear of the entryway 24. Various sub-assemblies are used in combination to position and facilitate movement of the entry wall 22. Referring to FIGS. 29A-32F, the example wall-entry bathtub 10 includes mounting brackets 78, track assemblies 83, roller assemblies 89, and counterweight assemblies 90, 92.

Referring to FIGS. 30A-30D, the mounting brackets 78 are positioned proximate the side walls 14, 16 to capture the shell 11 to the frame 48, and to provide a mount for the track assemblies 83. The mounting brackets 78 are shown as generally C-shaped channels defining a first flange 250 and second flange 252 joined by a web 254. A plurality of fasteners 258 extend through slotted openings 256 formed in the first flange 250 and are fastened to the frame 48 (shown in FIG. 14). The slotted openings 256 allow the mounting brackets 78 (and, thus, the entry wall 22 ultimately engaged therewith) to be adjusted in a plane offset from a plane defined by the entry wall 22 (e.g., to prevent binding of the entry wall 22 during movement). In one example embodiment, the slotted openings 256 allow the mounting brackets 78 to move inward to remove racking/shimmy movement when the entry wall 22 is in motion, or outward to reduce binding. The web 254 also includes a series of threaded holes 260 for securing the respective rails 80, 82 of the track assemblies 83, as will be discussed in more detail below.

As will now be discussed, the track assemblies 83 and the roller assemblies 89 are configured to facilitate movement of the entry wall 22 between the generally lowered position and the generally raised position. The track assemblies 83 include rails 80, 82 configured to be coupled to mounting brackets 78 according to an example embodiment. The rails 80, 82 are shown having slotted mounting holes 194 formed through a web portion 262. The mounting holes 194 are configured to receive fasteners 196, which extend therethrough to engage the threaded holes 260 and secure the track assemblies 83 to the respective mounting bracket 78. The slotted mounting holes 194 allow the rails 80, 82, and, thus, entry wall 22, to be adjusted both toward and away from the front wall 15 to help establish the desired seal.

The example track assembly 83 further includes a pair of bracket members 68, 70 and a pair of entry wall position sensors 65 (see, e.g., FIG. 12) according to an example embodiment. The sensors 65 are shown mounted proximate to the bracket members 68, 70 in order to sense the position of the entry wall 22. In the example embodiment shown, the entry wall position sensors 65 are electronic limit switches 113 (see, e.g., FIG. 13) that are mechanically engaged when the entry wall 22 is in the raised position. According to other example embodiments, the sensors may be one or more electrical contacts, one or more capacitive sensors, one or more pressure sensors, one or more optical sensors, a combination of the above-referenced sensors, etc. One skilled in the art will appreciate the variety of sensors and arrangements suitable to monitor and/or determine the location of the entry wall 22.

With additional reference to FIGS. 9-14 and 31A-31 F, and specific reference to FIGS. 12, 13, and 31A-31F, the example construction of the bracket members 68, 70 is described. Only one bracket member 70 will be described, with the understanding that the other bracket member 68 is substantially similar. The bracket member 70 is configured to engage and vertically restrain a latch member 60 when the entry wall 22 is in the raised position. The bracket member 70 is in the form of a striker and is shown having a bottom leg 122 and a top leg 124 secured to the rail 82, as well as a bridge portion 126 extending between the bottom leg 122 and the top leg 124. An opening 128 in the bridge portion 126 is configured to receive a pin 116 (of the respective latch member 62). Further, the opening 128 is intended to restrain the pin 116 when the entry wall 22 is in the raised position and the pin 116 is extended (as will be discussed below, when a handle assembly 120 is not actuated), thereby maintaining the entry wall 22 in the raised position. The bottom leg 122 of the bracket member 70 includes an upper stop 130, preferably formed of a resilient material, which absorbs at least a portion of the momentum of the entry wall 22 when the entry wall 22 is moved into the raised position. The upper stop 130 includes a threaded shaft 131 and a pair of nuts 133 configured to capture the bottom leg 122 and allow the vertical position of the upper stop 130 to be adjusted, thereby helping to align the pin 116 with the opening 128 in the bracket member 70. Similarly, a lower stop 132A (shown in an alternative location only in FIGS. 9 and 10) may be mounted proximate the drip tray 44 to engage a lower corner of the entry wall 22 when the entry wall 22 is in the lowered position. In another embodiment, a lower stop 132 is mounted to a bottom cross member 278 of the inner frame 50 (see FIGS. 6 and 8) such that the lower stop 132 rests upon the drip tray 44 when the entry wall 22 is in the lowered position. In this embodiment, the lower stop 132 is generally disc-shaped and has a central mounting hole through which a fastener secures the lower stop 132 to the inner frame 50, without use of a mounting bracket.

[0080] With additional reference to FIGS. 14 and 32A-F, the example roller assemblies 89 will be described. The roller assembly 89 includes a series of preferably plastic, disc-shaped rollers 84, 85 that are rotatably mounted to a vertical member 49.

The vertical member 49 is shown generally Y-shaped and configured to support a plurality of rollers. A first fork 51 of each vertical member 49 is shown supporting a first grouping of rollers 84 (shown as a pair) that are oriented with their axes of rotation generally perpendicular to the interior surface 54 of the entry wall 22 (when the wall-entry bathtub 10 is fully assembled). A second fork 55 of each vertical member 49 is shown supporting a second grouping of rollers 85 (shown in series), which are oriented with their axes of rotation substantially perpendicular to axes of rotation the first rollers 84.

A pair of mounting sleeves 264 facilitate coupling the roller assemblies 89 to the entry wall 22 in the example embodiment shown. The mounting sleeves 264 are shown coupled to the vertical members 49 of the roller assemblies 89 proximate their base portion 268. The roller assembly 89 is coupled to the entry wall 22 by sliding the mounting sleeve 264 into a slot 276 formed in the inner frame 50 (see, e.g., FIG. 29A, showing the slot 276 contoured to receive the mounting sleeve 264) of the entry wall 22. A fastening element is then used to secure the roller assembly 89 relative to inner frame 50. In the embodiment shown, a fastener (e.g., a screw, bolt, etc.) is then inserted via opening 274 in a base plate 270 extending laterally from the base of the mounting sleeve 264 and into a bottom cross member 278 of the inner frame 50. It should be noted that the mounting sleeve 264 may also include one or more openings 280 through which conduits may be routed into the entry wall 22 to operate the selected control components 198. According to other example embodiments, any elements suitable for coupling the roller assemblies to the entry wall may be used.

Figure 14:
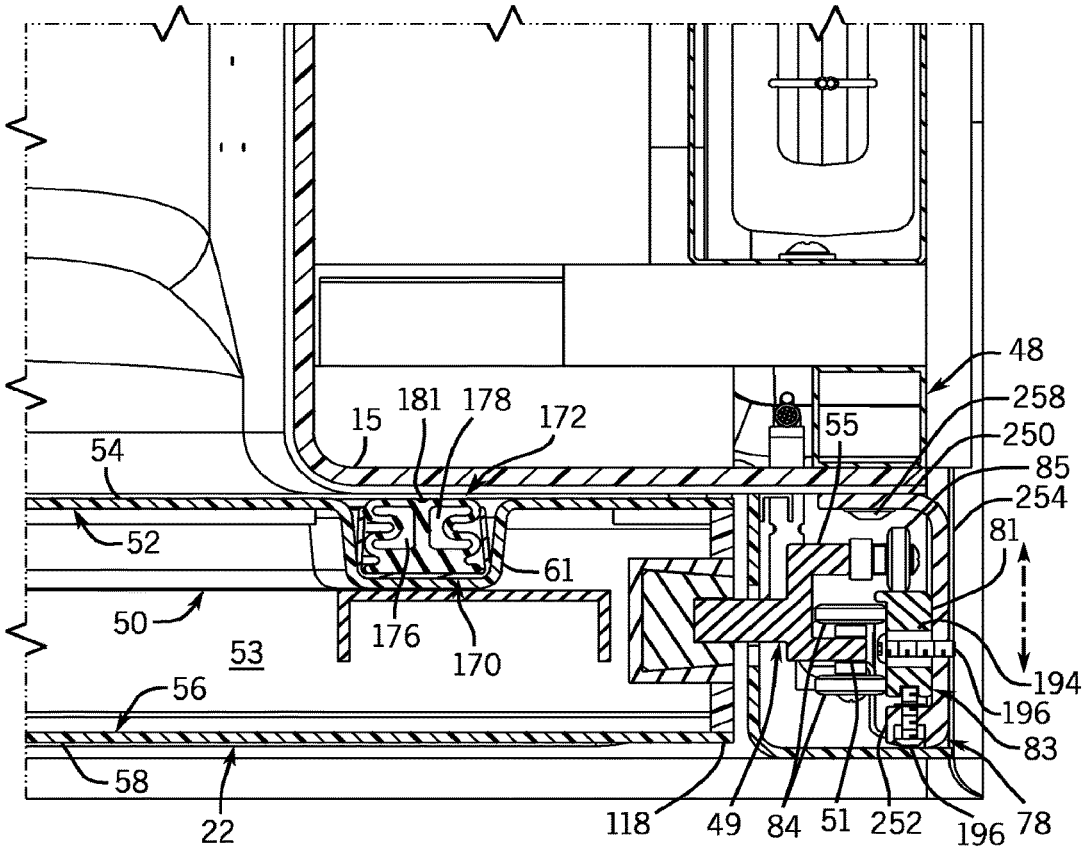
FIG. 14 is a partial, section view along line 14-14 shown in FIG. 5 including an alternative seal member.
Figures 15, 16:
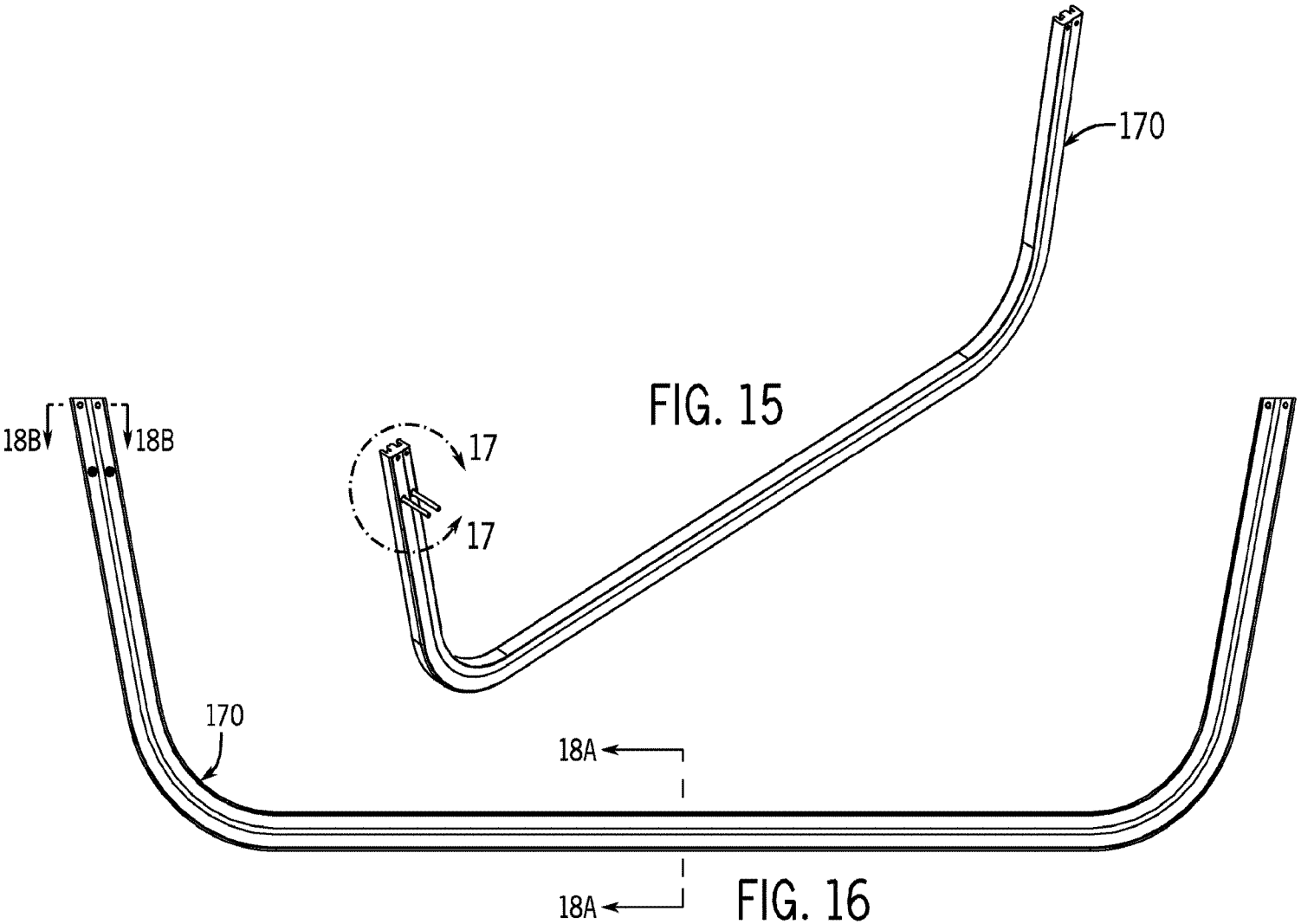
FIG. 15 is an isometric view of a preferred, example seal member.
FIG. 16 is a front plan view of the seal member shown in FIG. 15.
Figure 17:
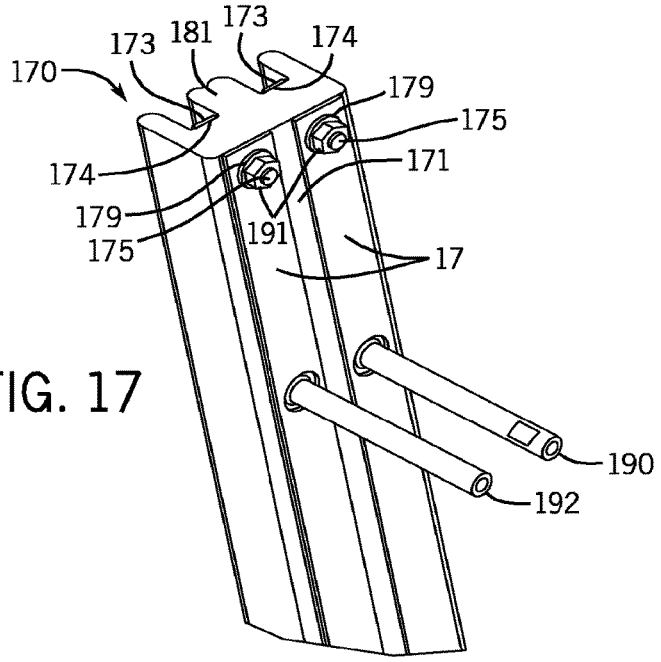
FIG. 17 is a partial detail view of area circumscribed by line 17-17 shown in FIG. 15.

Typically after the track assembly 83 is secured to the frame 48 and the roller assembly 89 is secured to the entry wall 22, the roller assembly 89 is positioned into engagement with the track assembly 83 such that the rollers 84, 85 are engaged with the rails 80, 82 (see, e.g., FIG. 14). Specifically, the rollers 84, 85 are movable (e.g., ride, travel, etc.) along the rails 80, 82 as the entry wall 22 is moved between the raised position and the lowered position. The preferred, example arrangement provides a robust, inexpensive arrangement to reduce the fictional force associated with moving the entry wall 22 between the lowered position and the raised position. Additionally, while some tolerance may allow outward movement of the entry wall 22, the orientation of the rollers 84, 85 (specifically rollers 85) restrains the entry wall 22 from moving away from the front wall 15 when a seal member 170 is expanded, as described below, beyond a predetermined amount. Any number and arrangement of rollers 84, 85 may be incorporated to provide the application-specific operation. For instance, while four pair of rollers 85 are illustrated, greater or fewer rollers 85 may be used to help move and then restrain (e.g., inhibit motion of, hold back, etc.) the entry wall 22 when the seal member 170 is expanded.

One skilled in the art will appreciate the various alternative constructions and arrangements available to slideably mount the entry wall 22, including the insubstantial modifications to the example construction. For example, a ball bearing array (i.e., an alternative type of "roller") may be secured to the frame 48 and the entry wall 22 may be captured to the shell 11 to ride along the ball bearing array by L-shaped brackets.

Referring to FIGS. 1-4, 9, 10, and 33, with the entry wall 22 mounted, two counterweight assemblies 90, 92 further reduce the force required to raise and lower the entry wall 22. In the example embodiment, the entry wall 22 weighs approximately fifty pounds force; however, an operator need not provide fifty pounds force to move the entry wall because the counterweight assemblies 90, 92 offset the weight of the entry wall 22. By offsetting the weight of the entry wall 22, the counterweight assemblies 90, 92 reduce the force required to raise and lower the entry wall 22 (e.g., approximately five pounds force). It should be noted that the magnitude to which the counterweight assemblies offset the weight of the entry wall may be varied. As a result, the force an operator must apply to raise and lower the entry wall may be less or more than five pounds force. It should also be noted that the weight of the entry wall may vary (e.g., because of material choice, construction, etc.).

Figure 32A:
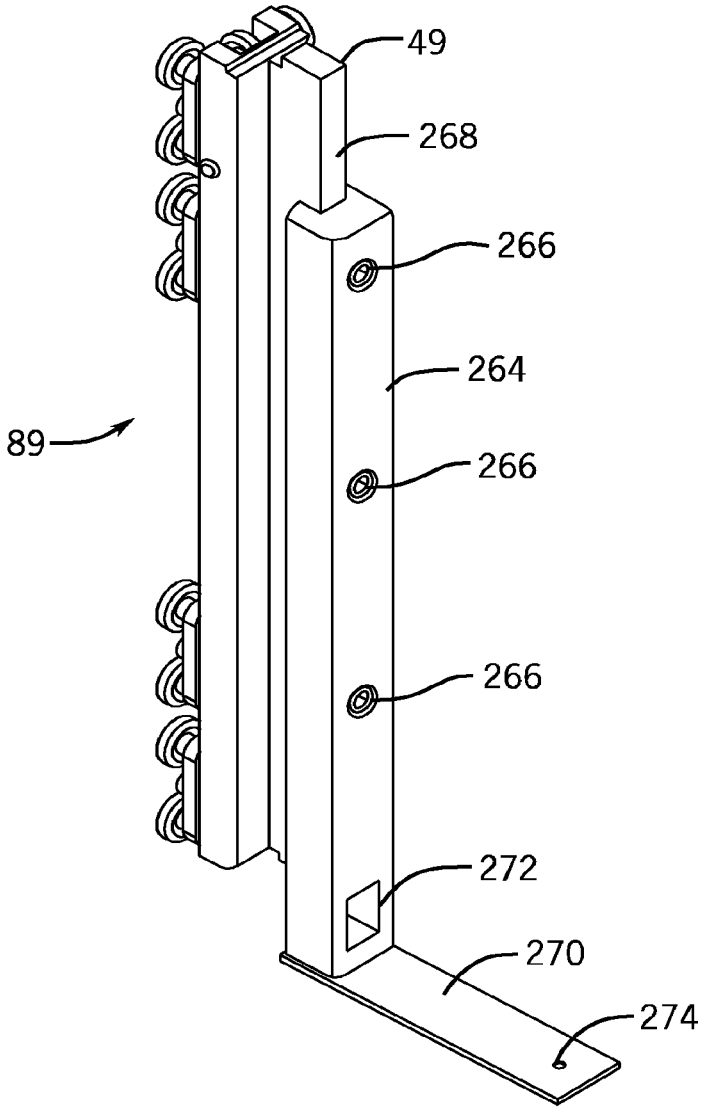
FIG. 32A is an isometric view of an example roller assembly.
Figure 32B:
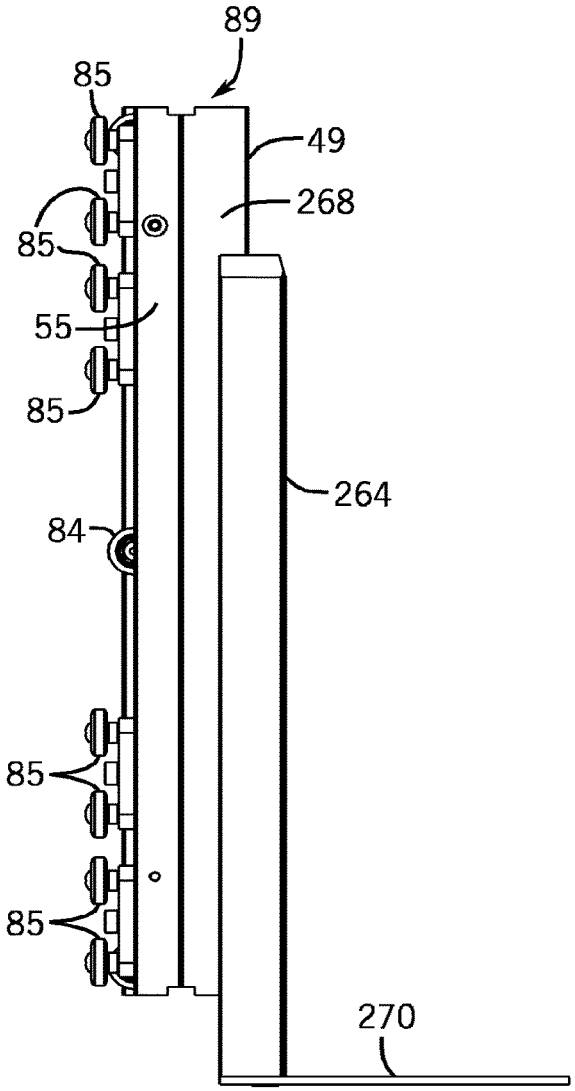
FIG. 32B is a rear plan view of the example roller assembly shown in FIG. 32A.
Figure 32C:
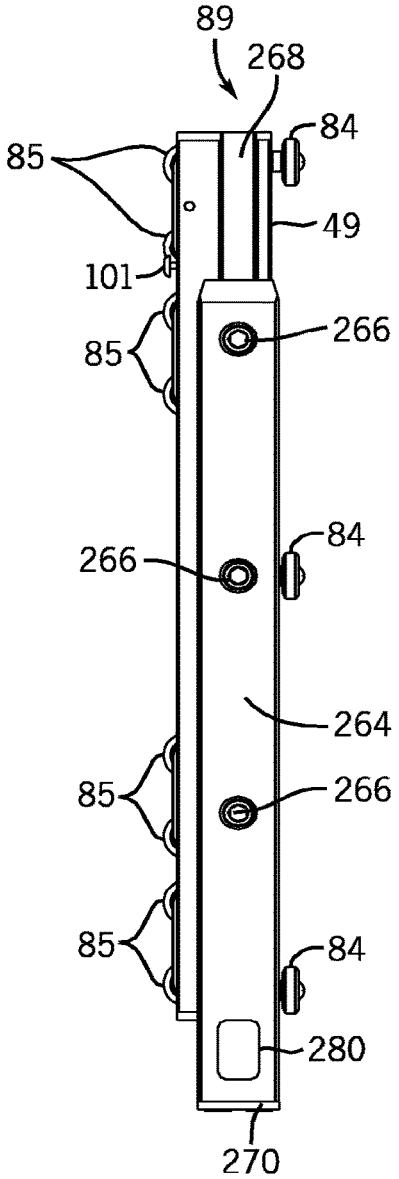
FIG. 32C is a side plan view of the example roller assembly shown in FIG. 32A.
Figure 33:
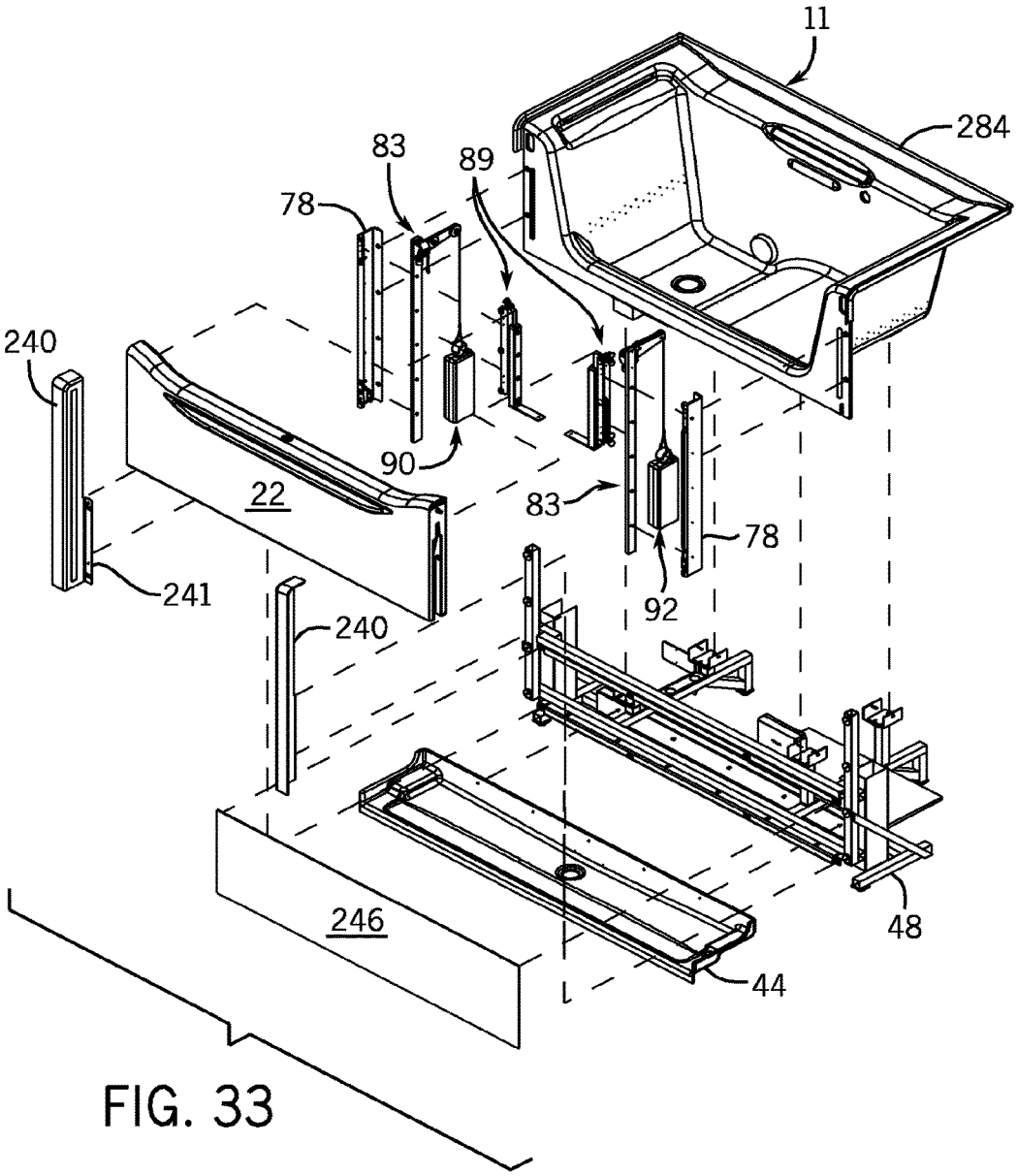
FIG. 33 is an isometric, exploded view of an example modular configuration of the example wall-entry bathtub.

With specific reference to FIGS. 3, 6, 9, 10, and 13, one counterweight assembly 92 is shown and will be described in greater detail with the understanding that the other counterweight assembly 90 is substantially similar. A bracket 94 is coupled near each of the respective upper ends 73, 74 of the rails 80, 82 to support one or more pulleys 96 according to an exemplary embodiment. The pulleys 96 the brackets 94 are generally part of the counterweight assemblies 90, 92, as will be discussed in more detail below. Two pulleys 96 are rotatably mounted to the bracket 94, one to a proximal end 97 and the other to a distal end 98 of the bracket 94. The counterweight assembly 92 includes a counterweight 108 and a cable 100 having a first end 102 and a second end 106 according to an example embodiment. The cable 100 is strung over the pulleys 96, the first end 102 secured to the roller assembly 89 being to one side of the pulleys 96 and the second end 106 secured to the counterweight 108 being to the other side of the pulleys 96 according to an exemplary embodiment. The first end 102 of the cable 100 is secured to the roller assembly 89 (e.g., crimped, integrally molded, glued, bolted, etc.), which, as discussed above, is in turn secured to entry wall 22. While FIG. 32C shows a fastener 101 extending form the fork 55 of the vertical member 49 to substantially fix the first end 102 of the cable 100 thereto, other suitable securing of the cable to the roller assembly 89 may be used. The second end 106 of the cable 100 is secured to the counterweight 108, which is slideably received within a sleeve 110 (shown U-shaped) configured to guide the substantially vertical movement of the counterweight 108 as the entry wall 22 is moved between the raised position and the lowered position. The counterweight 108 of the example embodiment is sized to fit within lateral pockets 107 defined by the U-shaped sleeve 110, and located proximate one of side walls 14, 16. As noted above, the counterweight assemblies 90, 92 are shown configured to require no greater than approximately five pounds of force to move the entry wall 22 between the lowered position and the raised position. According to another example embodiment, multiple cables may be used and/or the pulley system may be a complex pulley system.

Referring to FIGS. 9-14 the example construction and operation of the latch members 60, 62, in combination with the example bracket members 68, 70, is described. Only one latch member 60 and bracket member 68 will be described, with the understanding that the other latch member 62 and bracket member 70 combination is substantially similar.

The entry wall 22 further includes latch members 60, 62 mounted to a top cross member 109 (see, e.g., FIG. 12) of the inner frame 50 proximate respective upper corners 64, 66 of the entry wall 22 according to an example embodiment. When the entry wall 22 is moved into the fully raised position, the latch members 60, 62 engage the bracket members 68, 70, thereby inhibiting downward movement of the entry wall 22 until desired. One skilled in the art will appreciate that the entry wall 22 may incorporate a single latch member, and need not include two or more latch members in order to selectively fix the entry wall 22 in the desired location. Such a single-latch configuration may be configured substantially as described below with reference to the pair of latch members 60, 62, albeit with a single latch member.

The latch member 62 of the example embodiment includes an L-shaped mounting bracket 112 secured to the top cross member 109 and to a latch body 114. The mounting bracket 112 may also include slotted mounting holes allowing for adjustability of the mounting bracket 112 positioning. A spring loaded pin 116 extends outward from the latch body 114 and beyond a side 118 (see, e.g., FIG. 8) of the entry wall 22. The inner end of the pin 116 is coupled to a cable 119 that extends toward a handle assembly 120 for actuating the pin 116 from the extended position toward which the pin 116 is biased (illustrated, e.g., in FIG. 12) to a retracted position, thereby clearing the bracket member 70 and not inhibiting movement of the entry wall 22.

Figure 12:
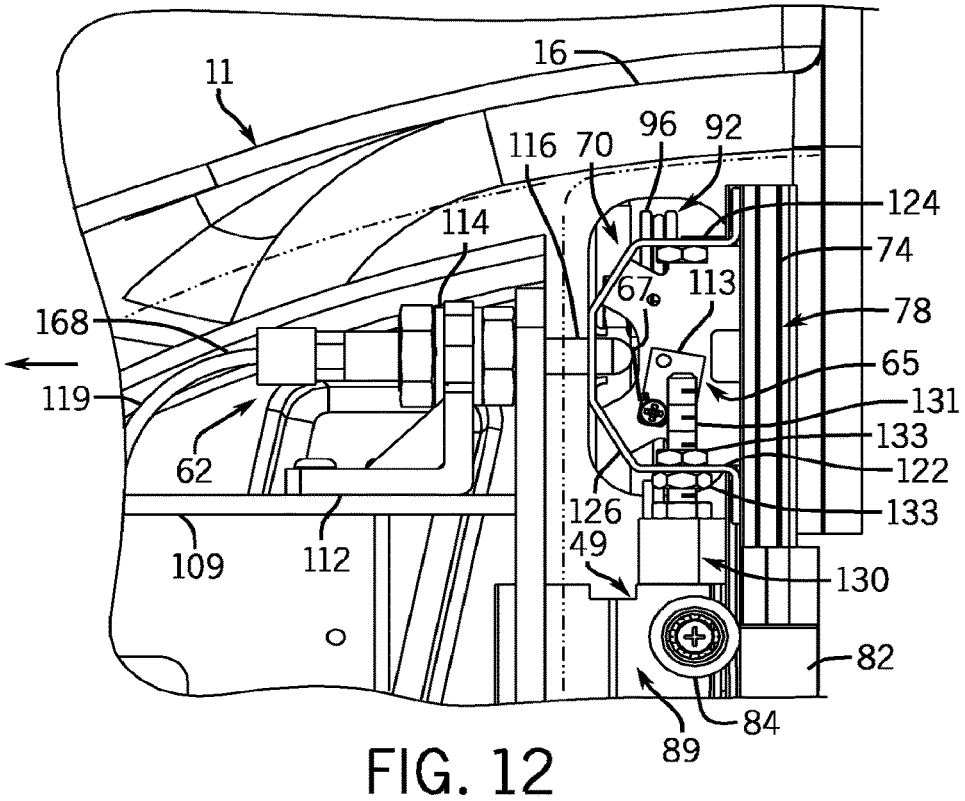
FIG. 12 is a partial view of the area circumscribed by line 12-12 shown in FIG. 10 illustrating an example latch member and an example bracket member.
Figure 13:
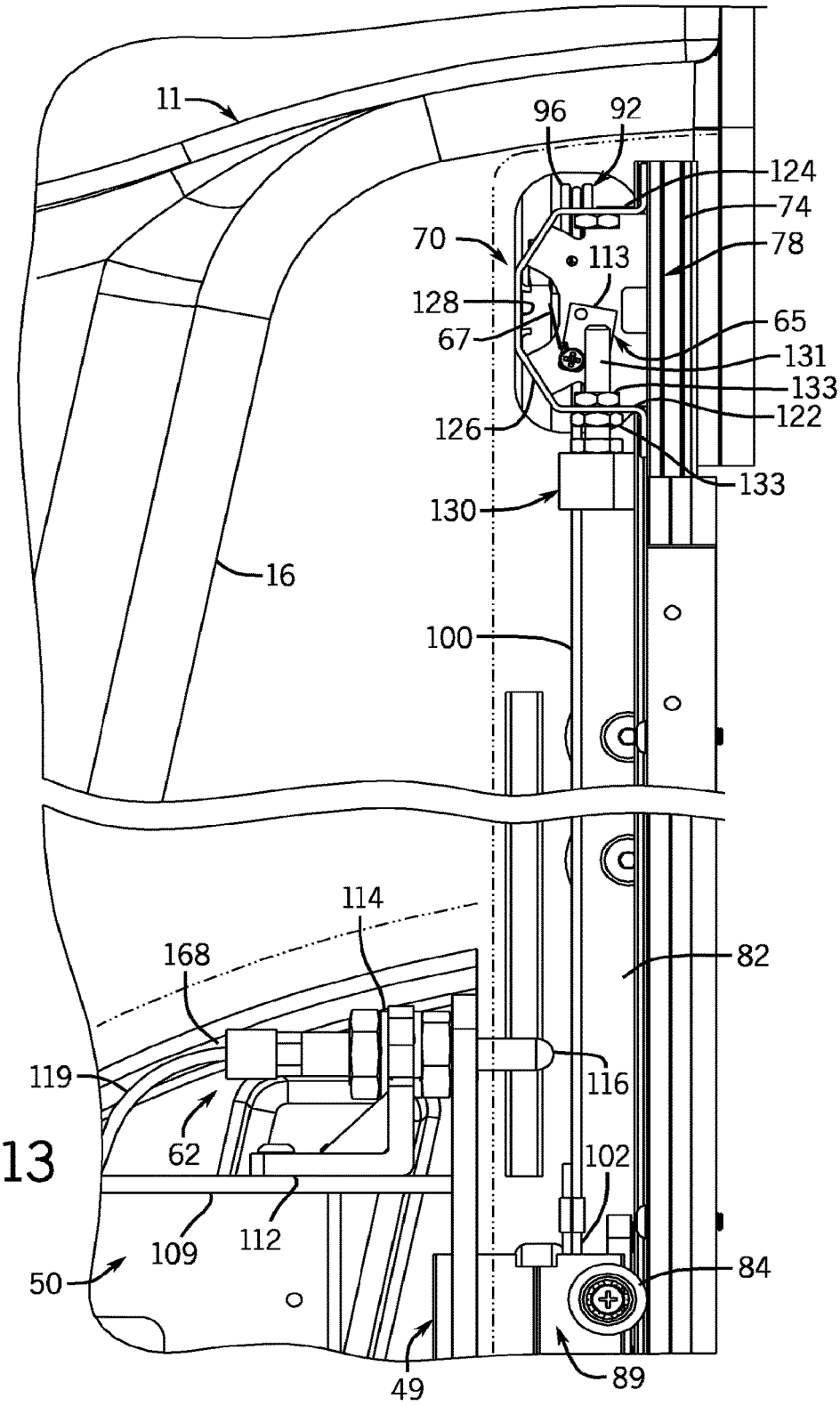
FIG. 13 is an enlarged detail view of portions of FIG. 9.

Referring in particular to FIGS. 12 and 13, the bracket member 70 is configured to engage and vertically restrain the latch member 62 when the entry wall 22 is in the raised position. Specifically, the opening 128 formed in the bridge portion 126 receives and restrains the pin 116 when the entry wall 22 is in the raised position and the pin 116 is extended, that is, the handle assembly 120 is not actuated. The entry wall position sensors 65 (e.g., an electronic limit switch 113) are also clearly shown in FIG. 12 having the pin 116 engaging the finger 67 of the example entry wall position sensor 65, thus changing the state of the position sensor 65 and thereby indicating engagement with the pin 116. While an example arrangement and construction is shown, one skilled in the art will appreciate the variety of latch member 62-bracket member 70 combinations suitable to selectively restrain the entry wall 22 in the raised position.

Referring to FIGS. 6, 8-13, and 29A the wall-entry bathtub 10 further includes a handle assembly 120 configured to actuate both of the latch members 60, 62 substantially simultaneously according to an example embodiment. With the handle assembly 120 actuated, the entry wall 22 can be uncoupled from the bracket members 68, 70 and moved from the raised position toward the lowered position. With specific reference to FIGS. 6, 8-13, and 29A, the handle assembly 120 includes a handle 136 positioned or recessed within a pocket 138 proximate an upper portion 140 of the entry wall 22 such that the handle 136 is at least partially obscured in an aesthetically pleasing manner. Referring in particular to FIG. 29A, the pocket 138 of the example embodiment is shown as a separate member that, for example, is glued into the exterior wall 56. According to another example embodiment, the pocket 138 may be integrally molded with the exterior wall 56 and may take on a variety of configurations. According to some example embodiments, the handle is not positioned in a pocket, but, rather, is integral with the door or takes any form suitable for facilitating uncoupling and movement of the entry wall 22.

According to the example embodiment shown, the handle 136 includes a generally flat portion 142 for being engaged by the operator (e.g., bather, caretaker, etc.) and a distal end 144 that is rotatably coupled to a block 146, the block 146 being secured to the top cross member 109 of the inner frame 50 of the entry wall 22. A link member 150 is oriented approximately ninety degrees relative to the handle 136 and is fixed relative to the handle 136. Accordingly, as the handle 136 is pulled upward (generally in the direction of arrow U on FIG. 11), the link member 150 pivots about a pivot point P. Bushings 147 and pin 149 are engaged with the block 146 to aid rotation of the handle 136 and link member 150. In one example embodiment, the pin 149 is welded to the distal end 144 of the handle 136 to reduce relative movement at the connection. In another example embodiment, the pin 149 may be captured to the handle 136 via a threaded coupling.

A distal end 152 of the link member 150 is coupled to a plunger 154 that is housed in a body 156 secured to a central cross member 158 (of the inner frame 50) via a bracket 160 according to an example embodiment. The bracket 160 includes slotted openings 161 configured to allow the placement of the bracket 160 and plunger 154 to be adjusted along the central cross member 158. As the plunger 154 moves leftward (as viewed from FIG. 11 in direction L), the plunger 154 urges ends 162, 164 of respective cables 117, 119 that are fixed to the plunger 154 away from the sides 118 of the entry wall 22 and generally toward the plunger 154. Distal ends 166, 168 of the cables 117, 119 are coupled to respective pins 115, 116. Accordingly, as the plunger 154 urges ends 162, 164 of cables 117, 119, the pins 115, 116 are urged inward away from and out of engagement with the respective bracket members 68, 70. With the pins 115, 116 disengaged, the entry wall 22 is no longer secured in the raised position and may be moved from the raised position toward the lowered position, provided the seal member 170 does not inhibit such movement. Furthermore, as one skilled in the art will appreciate given the benefit of this disclosure, the handle 136 (and associated components) may be configured for left hand or right hand operation.

It should be noted that, when the entry wall 22 is moved from the lowered position to the raised position, the spring loaded pins 115, 116 engage the respective bracket members 68, 70, thereby restraining the entry wall 22 in the raised position when the handle 136 is not actuated.

With the entry wall 22 in the raised position, a seal member 170 is expanded to fill a gap 172 (see, e.g., FIG. 14) disposed between the front wall 15 and the interior surface 54 of the entry wall 22. With the seal member 170 expanded, the gap 172 is substantially closed and a seal is formed between the entry wall 22, thereby allowing the wall-entry bathtub 10 to be filled with water. The preferred seal member 170 is shown in FIGS. 15-18B, and a cross section of another example alternative seal member 170 configuration is shown in FIG. 14. The seal member 170 is secured along the interior wall 52 of the entry wall 22 such that the seal member 170 is positioned generally adjacent the entryway 24 when the entry wall 22 is in the raised position. With specific reference to FIGS. 15-18B, the preferred seal member 170 of the example embodiment is generally B-shaped having the long side 171 secured in a channel 61 formed in the interior surface 54 of the interior wall 52 by a gasket member 17. The gasket member 17 has a generally rectangular cross-section with adhesive on the opposing longer sides (as viewed in cross-section).

Figure 18A:
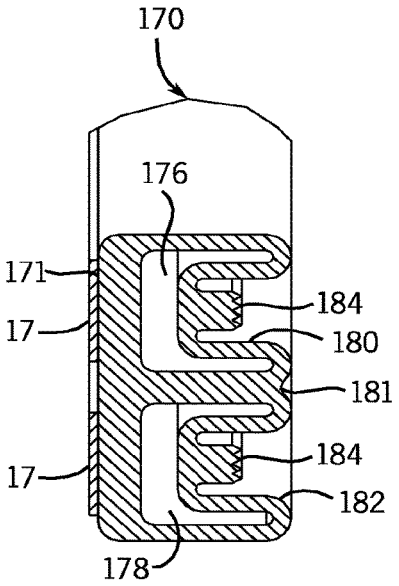
FIG. 18A is a section view along line 18A-18A shown in FIG. 16.
Figure 18B:
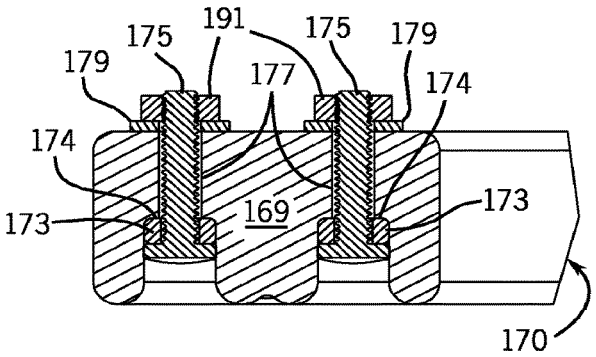
FIG. 18B is a section view along line 188-188 shown in FIG. 16.

With specific reference to FIG. 18A, the preferred seal member 170 includes a primary chamber 176 and a secondary chamber 178, each of which are preferably independently inflated. Both the primary chamber 176 and the secondary chamber 178 include expandable portions 180, 182 that expand to engage the front wall 15, thereby inhibiting water from leaking past the seal member 170. A common dividing wall 181 divides the primary chamber 176 and the secondary chamber 178 such that the cross sections of the primary chamber 176 and the secondary chamber 178 of the example embodiment are substantially similar. In the preferred example embodiment, the expandable portions 180, 182 include ribs 184 configured to further seal against the front wall 15 when the seal member 170 is expanded.

According to the example embodiment, the primary chamber 176 and the secondary chamber 178 are asymmetrically inflated. For example, the primary chamber 176 begins inflating before the secondary chamber 178 begins inflating. In some example embodiments, the primary chamber 176 may be fully inflated (in terms of a predetermined pressure range) before the secondary chamber 178 begins inflating, while in other example embodiments the secondary chamber 178 begins inflating before the primary chamber 176 is fully inflated. In other example embodiments, the primary chamber 176 and the secondary chamber 178 may be expanded substantially simultaneously. For example, a pair of compressors (one configured to inflate the primary chamber 176 and one configured to inflate the secondary chamber 178) or appropriate valving/conduits (e.g., a T-connection) may result in the primary chamber 176 and the secondary chamber 178 being inflated (and optionally deflated) substantially simultaneously.

The seal member 170 of the example embodiment includes rubber plugs 169, one plug 169 being vulcanized/cured into each end of the seal member 170, as understood by one skilled in the art. As shown in FIG. 188, the preferred embodiment of the seal member 170 includes a pressure plate 173 that is generally in the form of a rectangular cube seated in spaces 174 defined adjacent the dividing wall 181. A fastener 175 (e.g., a bolt) extends through a hole in the pressure plate 173 and an opening 177 in the seal member 170, and a washer 179 is captured adjacent the long side 171 of the seal member 170 by a mating fastener 191 (e.g., a nut). As a result, the integrated rubber plug 169 and seal member 170 are clamped between the washer 179 and the pressure plate 173. This configuration further inhibits damage to the seal member 170 (e.g., cracking, tearing, etc.) during the cyclical inflation and deflation of the seal member 170. The seal member 170 may be made of ethylene propylene diene monomer rubber and affixed to the channel 61 by the gasket member 17, which may comprise a double-sided adhesive tape. The seal member 170 may also be made of other materials suitable for being deformed to establish a seal for use in a wall entry bathtub. The bonds between the seal member 170, gasket member 17, and interior wall 52 are preferably water-tight to inhibit leaks.

According to an example embodiment, a compressor 204 is in fluid communication with a primary port 190 and a secondary port 192 of the primary chamber 176 and secondary chamber 178, respectively (see, e.g., FIG. 17), via a flow controller 188 (e.g., a solenoid switch), to allow pressurized air to be directed into the primary chamber 176 and/or the secondary chamber 178. One skilled in the art will appreciate the various systems available to expand the seal member 170. For example, a first compressor may be used to inflate the primary chamber 176 and a second compressor may be used to inflate the secondary chamber 178, without use of a flow controller 188. Alternatively, the compressor 204 may be a fluid pump that directs pressurized fluid into the seal member 170 to selectively expand and contract the seal member 170.

The size of the gap 172 between the unexpanded seal member 170 and the front wall 15 is preferably adjusted during assembly of the wall-entry bathtub 10 to ensure that a fully expanded (e.g., inflated) seal member 170 will provide sufficient pressure to inhibit water from leaking between the seal member 170 and the front wall 15. To adjust the size of the gap 172, the entry wall 22 may be configured to be adjustable toward and away from the front wall 15. Referring, for example, to FIG. 14, in one embodiment, the rails 80, 82 include a series of slotted mounting holes 194 oriented generally perpendicular to the front wall 15 such that the rails 80, 82, and, thus, the entry wall 22 coupled to the roller assemblies 89, may be adjusted to alter the size of the gap 172 (i.e., in a direction generally perpendicular to the plane of the entry wall 22). A series of set screws 196 extend into holes in the rails 80, 82 to help adjust and fix the location of the rails 80, 82 once the desired gap 172 has been set. If the gap 172 is adjusted too large, water may leak; however, if the gap 172 is adjusted too small, the seal member 170 may drag along (e.g., rub against, etc.) the front wall 15 as the entry wall 22 is moved between the lowered and raised positions. As noted above, the mounting brackets 78 may also include a series of slotted openings 256 and/or other adjustment features that allow the mounting brackets 78 (and, thus, the engaged entry wall 22) to be adjusted in a plane offset from and generally parallel to the plane defined by the entry wall 22 (e.g., to prevent binding and reduce play in the entry wall 22 as it moves between the raised position and the lowered position), thereby accounting for application-specific variations that may otherwise degrade the operation of the entry wall 22.

Figure 19:
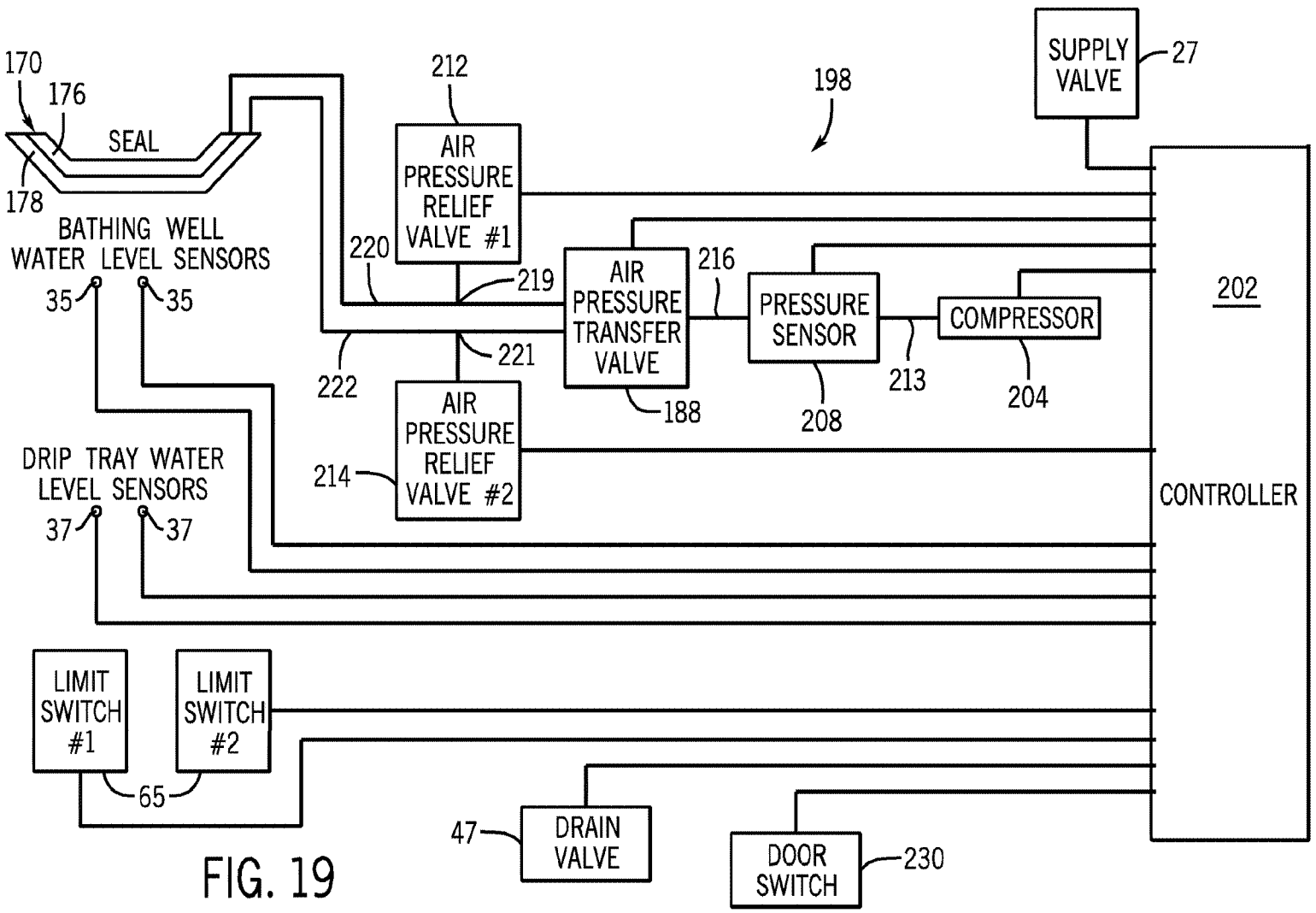
FIG. 19 is a simplified schematic of example control components for use with the example wall-entry bathtub.

A variety of other components facilitate the operation and use of the example wall-entry bathtub 10. For example, FIG. 19 shows a simplified schematic of the example control components 198, some of which may be positioned within the cavity 53 of the entry wall 22 and others that may be generally located on the platform 47 (shown in FIG. 1). A controller 202, of the example embodiment, is in communication with basin water level sensors 35, drip tray water level sensors 37, entry wall position sensors 65, supply valve 27, drain valve 40, compressor 204, a flow controller 188, a pressure sensor 208, relief valves 212, 214, and a control or door switch 230. In the example arrangement, and with additional reference to FIG. 29C, the compressor 204 provides pressurized air via line 213 to pressure sensor 208, which in turn directs the pressurized air to the flow controller 188 via line 216. The controller 202 toggles the flow controller 188 to direct the pressurized air to the primary chamber 176 and secondary chamber 178, as required, via lines 220, 222. The respective relief valve 212, 214 is in fluid communication with lines 220, 222 via respective T-fittings 219, 221 (see, e.g., FIG. 29C) in lines 220, 222 such that the controller 202 can open and close the desired relief valve to either allow the primary chamber 176 and secondary chamber 178 to be expanded (e.g., pressurized) or retracted (e.g., deflated by exhausting the pressurized air with the primary chamber 176 and/or secondary chamber 178 to the atmosphere), thereby engaging and disengaging the seal member 170 with the front wall 15. In the example embodiment, the T-fitting 219 couples the flow controller 188, the relief valve 212, and the primary port 190 of the seal member 170, and the T-fitting 221 couples the flow controller 188, the relief valve 214, and the secondary port 192 of the seal member 170.

In the example embodiment, the compressor 204, pressure sensor 208, flow controller 188, relief valves 212, 214, and associated lines 213, 216, 220, 222 are housed within the cavity 53 defined by the entry wall 22. Specifically, as one alternative embodiment shown in FIG. 29B (i.e., including multiple compressors) illustrates, these components are generally mounted to a panel 282 that is secured to the inner frame 50. Therefore, the only conduits that are preferably routed into the moveable entry wall 22 are those that provide power or signals for the control components 198 housed within the cavity 53. Additionally, the cavity 53 in entry wall 22 may house a control connection 231 between the control components 198 and the controller 202 mounted to the platform 47. A rigid member (not shown), such as a wire or tube, may be secured to the conduit to provide some rigidity to the conduit as it is routed from proximate the frame 48 toward the entry wall 22.

With specific reference to FIG. 29C, a preferred configuration of various control components 198 is illustrated. In this embodiment, a single compressor 204 includes an inlet port 205 and an outlet port 207. The outlet port 207 is in fluid communication via the pressure sensor 208 with the flow controller 188 (e.g., a three-way valve). The flow controller 188 is in fluid communication with the relief valves 212, 214 and the primary port 190 and the secondary port 192 via respective T-fittings 219, 221. In preferred embodiments, many of the couplings between control components 198 are facilitated by barbed hose fittings made of brass, but may be of any other suitable construction. In addition, a first end of a tube or hollow elongated member 209 is in fluid communication with the inlet port 205 of the compressor 204, and a second end of the tube 209 is open to the atmosphere. The tube 209 is intended to reduce unwanted noise produced by the compressor 204 during operation, and may have an application-specific size and length (e.g., approximately one foot in length). Stated otherwise, the tube 209 is configured to act as a muffler for the compressor 204, and given the benefit of this disclosure, one skill in the art will appreciate the various configurations and form factors available to muffle the compressor 204 housed in the entry wall 22.

With additional reference to FIGS. 3, 8, 29A, and 29C, the electrical configuration of the example control components 198 is described. In one example arrangement, the various electrical leads of the compressor 204, door switch 230, pressure sensor 208, flow controller 188, relief valves 212, 214, and a power line are electrically coupled to a terminal block 261 mounted on the panel 282. In this arrangement, the control connection 231 provides for electrically coupling the control components 198 and the controller 202. Specifically, the terminal block 261 is operationally coupled to a first conduit 231A of the control connection 231 that, in one example arrangement, is routed along the bottom of the inner frame 50. The first conduit 231A is connected to a second conduit 231 B proximate a corner of the entry wall 22 (see, e.g., FIG. 29A). The second conduit 231 B is routed toward and operationally coupled to the controller 202. A rigid member may be integral with the second conduit 231 B to help support and locate the second conduit 231 B adjacent the shell 11 during operation of the entry wall 22.

The various components described above may be formed and manufactured from standard materials and techniques known and understood by one of ordinary skill in the art.

In operation, the various components are controlled by the controller 202 in connection with pre-determined logic stored on memory (not shown) in the controller 202. For purposes of describing the example operation of the wall-entry bathtub 10, it is assumed that the entry wall 22 is in the lowered position (shown in FIG. 1), the supply valve 27 (if present) is closed, the drain valve 40 is open, the first drain 36 is unobstructed, and the relief valves 212, 214 are open (i.e., venting the primary chamber 176 and secondary chamber 178 to the atmosphere) or are closed but the pressure within the primary chamber 176 and the secondary chamber 178 is substantially at atmospheric pressure. To fill the wall-entry bathtub 10, an operator turns on the supply water by any conventional mechanical or electromechanical valves, or by indicating to the controller 202 to open the supply valve 27 (e.g., via a user interface panel). If the first drain 36 is unobstructed, water flows from the integral fill 26 into the sunken portion 33 of the basin 12 before flowing out of the basin 12 via the first drain 36 and/or second drain 38, if necessary.

With the desired water temperature set, the operator (e.g., bather) manually closes the first drain 36 by, for example, actuating the "tap-toe" 228 (see, e.g., FIG. 1) that, when in the closed position, obstructs (e.g., blocks, closes off, plugs, etc.) the first drain 36, allowing water to begin to fill up the sunken portion 33 of the basin 12. The controller 202 may be configured to monitor the basin water level sensors 35 and the entry wall position sensors 65 so that, if the basin water level sensors 35 sense water at a certain level within the basin 12 (e.g., close to breaching the entryway 24) and the entry wall 22 not in the fully raised position, the controller 202 shuts off the supply valve 27 to prevent water from spilling out of the entryway 24.

As the water is flowing from the integral fill 26 in the basin 12, the bather may completely enter the wall-entry bathtub 10 through the entryway 24. Once positioned with their lower extremities generally in the basin 12, the bather may grab the entry wall 22, such as by grasping the pocket 138 that is formed in the upper portion 140 of the entry wall 22 and applying a force (generally upward or vertical, as shown) to move the entry wall 22 from the lowered position toward the raised position. In the exemplary embodiment shown, the counterweight assemblies 90, 92 are configured such that approximately five pounds of force is all that is required for the bather to move the entry wall 22 from the lowered position to the raised position. As the entry wall 22 approaches the raised position, the pair of spring loaded pins 115, 116 of latch members 60, 62 engage the respective bracket members 68, 70. Also, the entry wall position sensors 65 (e.g., electronic limit switches 113) sense the raised position of the entry wall 22 (when the pins 115, 116 push against the fingers 67 of the entry wall position sensor 65 in the example embodiment shown) and signal the position of the entry wall 22 to the controller 202. In the example embodiment described, electronic limit switches 113 are in communication with the controller 202, and the controller 202 monitors both entry wall position sensors 65 to ensure proper operation of the wall-entry bathtub 10 and engagement of the entry wall 22 when in the fully raised position.

With the entry wall 22 in the raised position, and the controller 202 registering that both entry wall position sensors 65 are locating the entry wall 22 in the raised position, the controller 202 may be configured to close the drain valve 40, which is preferably a normally-open valve, direct the flow controller 188 into the primary chamber 176 setting, and energize the compressor 204 to inflate the seal member 170. If only one of the pair of entry wall position sensors 65 register a raised position of the entry wall 22, the controller 202 may provide an alarm, indicating the error condition, and not close the drain valve 40. In some cases, if the alarm goes off two or more times in a row, the wall-entry bathtub 10 may "lock-out" bathers, preventing them from using the wall-entry bathtub 10 until the issue is resolved.

The controller 202 may alternatively be programmed to first inflate the seal member 170 prior to closing the drain valve 40, thus, confirming the proper operation of the seal member 170 prior to the basin 12 being filled with water above the sunken portion 33. In other configurations, the controller 202 may be configured such that at least the primary chamber 176 of the seal member 170 is suitably pressurized before the drain valve 40 is closed. The flow controller 188 may direct pressurized air from the compressor 204 to fill and expand the primary chamber 176 to a predetermined pressure range (e.g., a range of approximately eleven to fifteen pounds per square inch gage ("psig")) in the example embodiment shown. Then, when the pressure in the primary chamber 176 of the example embodiment reaches the desired pressure, the controller 202 closes the drain valve 40, which is preferably a normally-open valve, such that the second drain 38 no longer allows water in the basin 12 to drain. This configuration provides an additional check to ensure that the primary chamber 176 is inflating properly. Once the pressure sensor 208 indicates the desired pressure in the primary chamber 176, the controller 202 causes the flow controller 188 to direct the pressurized air from the compressor 204 to fill and expand the secondary chamber 178 of the seal member 170. In the example embodiment, the secondary chamber 178 is filled (e.g., for approximately thirty seconds) until it reaches a predetermined pressure range (e.g., including a pressure of approximately ten psig.). In the event that the controller 202 determines that the primary chamber 176 is not reaching or maintaining a pressure that is within the desired range (e.g., eleven to fifteen psig), the controller 202 may sound an alarm and inflate the secondary chamber 178 to a pressure within the desired pressure range of the first chamber 176 (e.g., approximately fifteen psig), this pressure typically being greater than the predetermined pressure to which the second chamber 178 would otherwise be inflated, so that the second chamber 178 may act as the primary seal. If both the primary chamber 176 and the secondary chamber 178 are not reaching the desired pressures, the controller 202 may open the drain valve 40 and prevent operation of the wall-entry bathtub 10 until the problem has been corrected.

Throughout use of the wall-entry bathtub 10, the controller 202 may monitor the pressure in the primary chamber 176 (and/or the secondary chamber 178) via the pressure sensor 208 to help ensure the primary chamber 176 (and/or the secondary chamber 178) is maintained within a predetermined pressure range (e.g., approximately thirteen to fifteen psig, or any other application-specific range). For example, the flow controller 188 may be regularly switched between the primary chamber 176 and the secondary chamber 178 such that the controller 202 monitors the pressure sensor 208 as it cyclically senses the pressure in the primary chamber 176 and the secondary chamber 178. If, for example, the pressure in the primary chamber 176 drops below the predetermined pressure range, the controller 202 may selectively activate the compressor 204 and flow controller 188 to increase the pressure. Should the controller 202 determine that the pressure in the seal member 170 cannot be maintained within the predetermined pressure range (e.g., if the compressor 204 malfunctions, the flow controller 188 fails, the seal member 170 is damaged, etc.), the controller 202 sounds an alarm, closes the supply valve 27 (preventing additional water from entering the basin 12), and opens the drain valve 40 to allow the water to be drained from the wall-entry bathtub 10.

According to one example embodiment, the controller 202 may also include a limited-use backup power supply that may be used should the main power to the controller 202 be lost. In the example embodiment, enough power is stored for approximately thirty seconds of operation. If power is lost, the drain valve 40 opens automatically because it is a normally open valve that requires power to remain in the closed state. The controller 202 enters a power save mode by monitoring the basin water level sensors 35. If the controller 202 determines that the water level has fallen below the basin water level sensors 35, the controller 202 opens the relief valves 212, 214 to allow the seal member 170 to deflate. The bather may then actuate the handle assembly 120, de-latching the entry wall 22, and move the entry wall 22 into the lowered position.

To drain the wall-entry bathtub 10 under normal conditions, the operator (e.g., bather) actuates the control 230 (e.g., a switch, trigger, toggle, pressure sensor, etc.), which in the example embodiment is mounted proximate a top rim 232 of the entry wall 22 and in communication with the controller 202 via a cable 233, only a portion of which is shown. When the controller 202 receives a signal from the control 230 (indicating that the operator wishes to drain the wall-entry bathtub 10), the controller 202 opens the drain valve 40. The controller 202 may be configured such that a second actuation of the control 230 indicates to the controller 202 to close the drain valve 40, thus allowing the bather to continue bathing, for example when the bather accidentally bumps the control 230. The operator (e.g., bather, caregiver, etc.) may manually open the first drain 36 to increase the rate at which water leaves the wall-entry bathtub 10 (e.g., by tapping it with their toe, foot, or hand). When the controller 202 determines that the water has dropped below the basin water level sensors 35, the controller 202 no longer maintains pressure in the seal member 170 and, in the example embodiment, opens the relief valves 212, 214 (e.g., for approximately thirty seconds) to allow the seal member 170 to deflate and retract. With the seal member 170 deflated and/or retracted into the channel 61, the friction between the seal member 170 and the front wall 15 is reduced or eliminated such that the operator may actuate the handle assembly 120 disengaging the latch members 60, 62 from the bracket members 68, 70. Then, with minimal force, the operator may move the entry wall 22 from the raised position into the lowered position, where the lower stops 132 will cushion the entry wall 22 movement.

The controller 202 may also include other logic to prevent use of the wall-entry bathtub 10 if all components are not operating as designed. For example, should the primary chamber 176 or secondary chamber 178 fail to reach the requisite operating pressure after a predetermined pressurization period (e.g., sixty seconds of compressor 204 operation), a warning (e.g., audible, visional, or a combination thereof) will be given to the operator that the system is not operating correctly. Similarly, if the compressor 204 must re-pressurize the seal member 170 more than three times during use, the controller 202 may again provide a warning and/or prevent use of the wall-entry bathtub 10 until the problem has been corrected. As another example, the drip tray water level sensors 37, which may be positioned in the drip tray 44 to detect a rising water level within the drip tray 44, are monitored by the controller 202. If the controller 202 determines that the water level in the drip tray 44 has exceeded a desired level, the controller 202 can close the supply valve 27 and open the drain valve 40, such that water begins to drain from the wall-entry bathtub 10. Alternatively, when the drip tray 44 is configured to use the same drain line (e.g., the secondary drain line) as the second drain 38, the controller 202 may be configured such that if the drip tray water level sensors 37 detect water, meaning that water has backed up into the drip tray 44, the drain valve 40 is closed to prevent any further water from entering the shared drain, under the assumption that the shared drain is blocked downstream of the central drain 46 of the drip tray 44. If the first drain 36, second drain 38, and drip tray 44 each have separate drain lines, the drip tray water level sensors 37 may be eliminated, if desired. Additionally, in one configuration, the basin water level sensors 35 may be monitored by the controller 202 such that when the entry wall 22 is in the raised position, the controller 202 will not allow the seal member 170 to be retracted (e.g., deflated) if water is sensed in the basin 12.

In another configuration, the drain valve 40 may be replaced or supplemented by a pump that draws water through the second drain 38 when the controller 202 determines that the shell 11 is to be drained. In one form, the pump may comprise a whirlpool jet pump in combination with the appropriate valving (preferably controlled by the controller 202) to place the whirlpool jet pump in fluid communication with a drain line, thereby evacuating water from the shell. Moreover, the first drain 36 may include a similar suction-type device to draw water from the shell 11 at an increased flow rate relative to gravitational flow.

Figure 20:
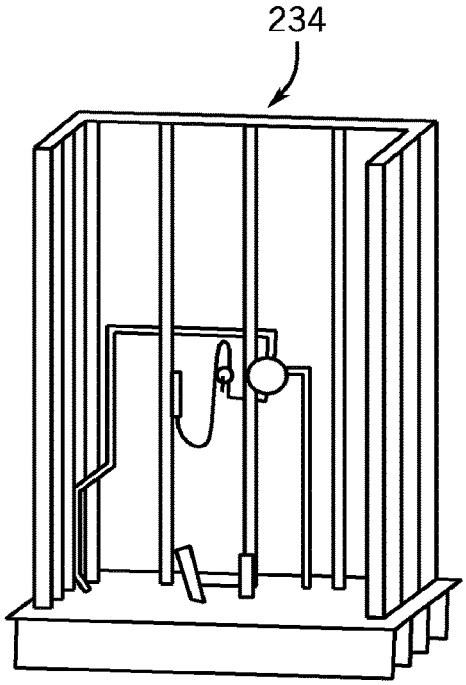
FIGS. 20-28 are isometric views depicting an example installation progression of the example wall-entry bathtub.
Figure 21:
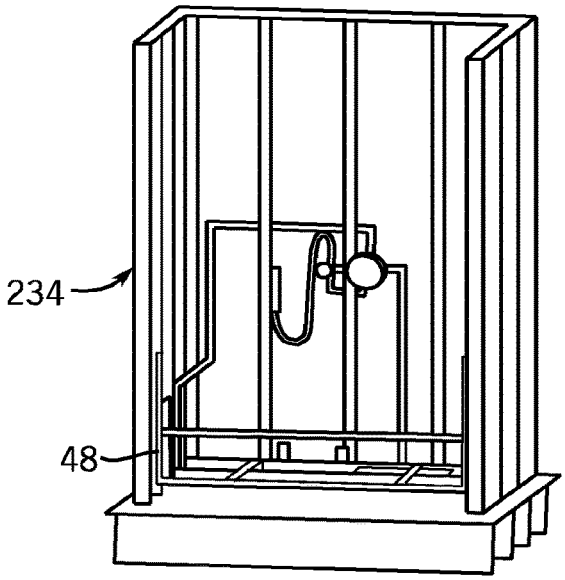
Figure 22:
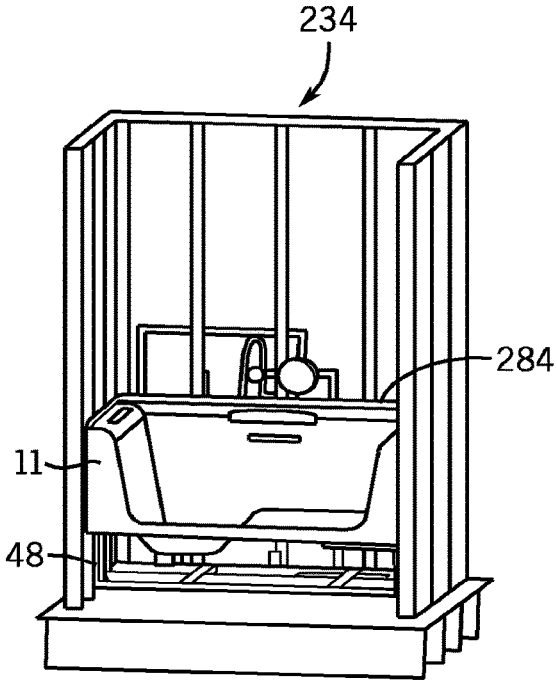
Figure 23:
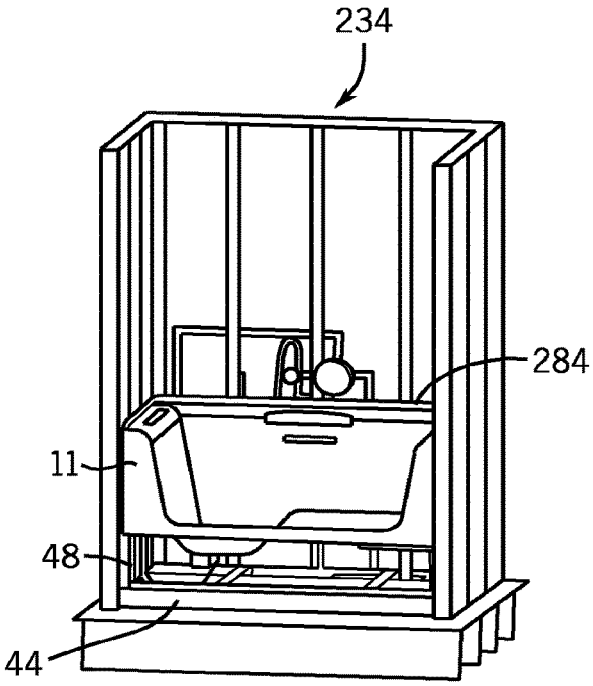

The ability to install the wall-entry bathtub 10 in existing structures, such as during the remodeling of a bathroom, is aided by the modular configuration of the wall-entry bathtub 10, as shown in FIGS. 20-28 and 33. A wall cavity or rough opening 234 is shown in FIG. 20 with the rough plumbing installed. During assembly of the wall-entry bathtub 10, the following assembly procedure describes one option in assembling the wall-entry bathtub 10. The frame 48 may be placed into the wall cavity 234 (as shown in FIG. 21) or, as shown in FIG. 22, the shell 11 may be first secured to the frame 48 via the mounts 59 and then the assembly of the frame 48 and shell 11 placed into the wall cavity 234. The shell 11 is then secured to the wall cavity 234 by fixing the installation flange 284 via fasteners (e.g., nails) and/or adhering elements (e.g., adhesive). Turning to FIG. 23, the drip tray 44 is installed beneath the shell 11 to the frame 48.

Figure 24:
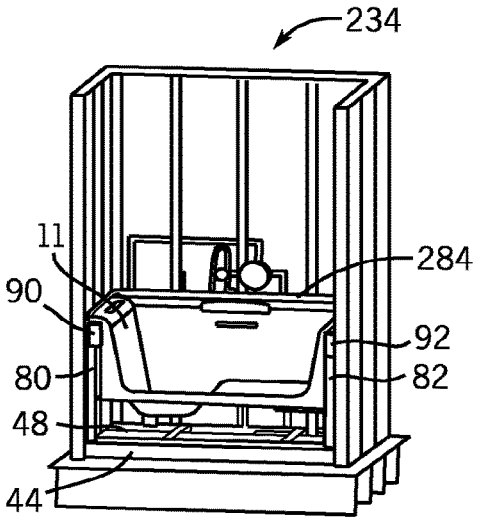
Figure 25:
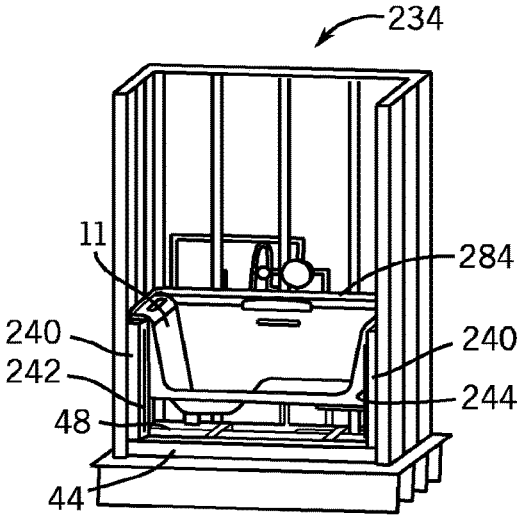
Figure 26:
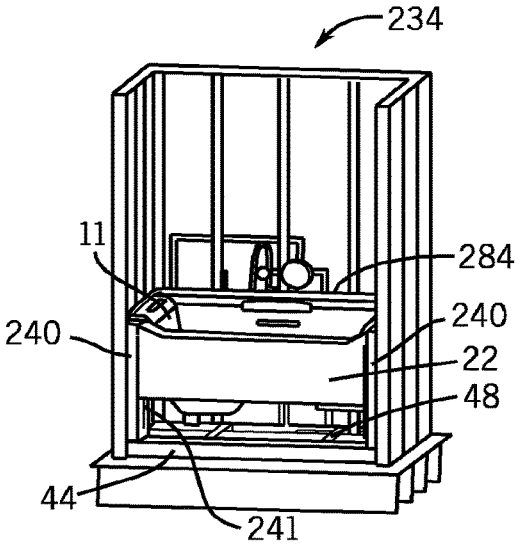
Figure 27:
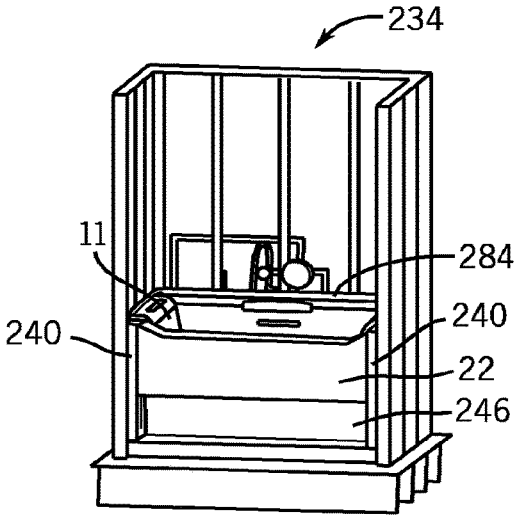
Figure 28:
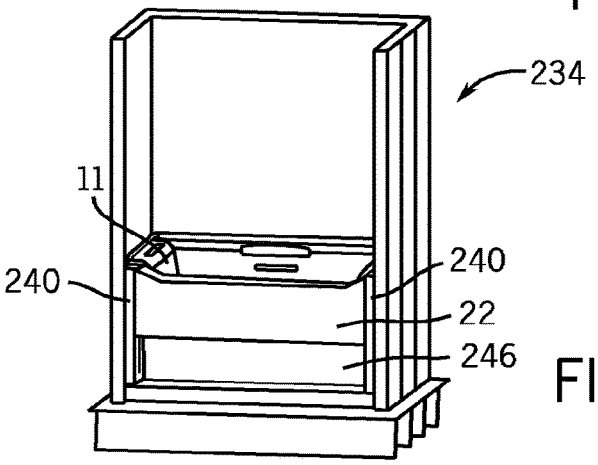

Referring to FIGS. 24 and 25, the mounting brackets 78 are secured through the shell 11 to the frame 48, and the track assemblies 83 are secured to the respective mounting brackets 78. The counterweight assemblies 90, 92 are also coupled to the respective track assemblies 83. Referring in particular to FIG. 3, the rear-most pulley 96 may be difficult to access during installation, specifically, routing the cable 100 over the pulley 96 may be challenging. To assist assembly, a guide tool in the form of a Z-shaped rigid wire (i.e., a top leg, and interconnecting leg, and a bottom leg) having an elongated bottom leg can be engaged with the cable 100, inserted through an opening 103 (shown in FIG. 3), and manipulated to route the cable 100 over the rear-most pulley 96. Thus, the cable 100 may be routed and installed from the entry wall 22 side when the shell 11 is seated into the wall cavity 234. End caps 240 can be installed to cover portions of the track assemblies 83. In one form, each end cap 240 is a vertically divided two-piece assembly where an outer member and an inner member are urged together by corresponding magnets. During installation, the outer member is typically adjacent to and partially embedded in a wall. A magnetic strip is affixed on the outer member and a co-acting magnetic strip is affixed on the inner member such that the inner and outer members are magnetically attracted to provide an aesthetically pleasing assembly and yet allow the inner member to be easily removed (even with the entry wall 22 installed) to gain access to the covered components. The end caps 240 include slots 242, 244 allowing for the engagement between the track assemblies 83 and the roller assemblies 89. In FIG. 26, the entry wall 22 (having the roller assemblies 89 secured thereto) is engaged with the track assemblies 83 and the counterweight assemblies 90, 92 are coupled to the respective roller assembly 89. Then, as shown in FIGS. 27 and 28, an access panel 246 is installed (e.g., flanges 241 may include releasable couplers, such as Velcro that engage mating releasable couplers on the access panel 246) and the wall 248 construction is completed.

The modularity of the example wall-entry bathtub 10 allows the wall-entry bathtub 10 to be easily installed in preexisting locations (e.g., such as during a bathroom remodel). For instance, the separation of the entry wall 22, track assemblies 83, roller assemblies 89, and counterweight assemblies 90, 92 provides additional convenience due to the reduced module size and weight, which provides easier navigation and transportation of the modules through restricted spaces (e.g., hallways, stairways, etc.).

While specific, example embodiments have been described above, various modifications falling within the breadth and scope of the claims will be apparent to one skilled in the art. For example, the basin could be of any other suitable shape, such as round or oval, with an entry wall having a corresponding shape.

It should be noted that various cables, hoses, and couplings have been removed throughout the figures for clarity and are generally represented schematically in FIG. 19; however, one skilled in the art, given the benefit of this disclosure, will appreciate the incorporation of these components.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the terms "example" and/or "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It should be noted that the orientation of various elements may differ according to other exemplary embodiments, and that such variations are intended to be encompassed by the present disclosure.

It is also important to note that the construction and arrangement of the bathtub as shown in the various exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed herein. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the various exemplary embodiments without departing from the scope of the present inventions.

What is claimed is:

1. A wall-entry bathtub, comprising:

a basin;

a shell defining an entryway to allow access into the basin;

an entry wall movable between a lowered position and a raised position, wherein the entry wall is substantially clear of the entryway in the lowered position and at least partially blocks the entryway in the raised position;

first and second entry wall position sensors configured to sense the position of the entry wall; and a controller in electronic communication with the first and second entry wall position sensors, wherein the controller is configured to control components of the bathtub based at least in part on the position of the entry wall;

wherein the controller is configured to provide an alarm indicating an error condition if at least one of the first and second entry wall position sensors sense that the entry wall is in the raised position.

2. The wall-entry bathtub of claim 1, wherein the controller is configured to close a drain valve when the first and second entry wall position sensors sense that the entry wall is in the raised position.

3. The wall-entry bathtub of claim 1, wherein the first and second entry wall position sensors are coupled to the basin.

4. The wall-entry bathtub of claim 1, further comprising:

a seal member disposed between the entry wall and the shell; and a compressor;

wherein the controller is configured to energize the compressor to inflate the seal member when the entry wall is in the raised position.

5. The wall-entry bathtub of claim 4, wherein the controller is configured to inflate the seal member prior to closing a drain valve.

6. The wall-entry bathtub of claim 1, further comprising a water supply valve and a basin water level sensor configured to sense a level of water below the entryway, wherein the controller is configured to close the water supply valve if the entry wall is in the raised position and the basin water level sensor senses a level of water.

7. The wall-entry bathtub of claim 1, further comprising a seal member disposed between the entry wall and the shell and a basin water level sensor configured to sense a level of water below the entryway, wherein the controller is configured to prevent the seal member from being deflated if water is detected in the basin by the basin water level sensor.

8. The wall-entry bathtub of claim 1, further comprising a drip tray and a drip tray water level sensor, wherein the controller is configured to open a drain valve if the controller determines that a water level in the drip tray has exceeded a desired level.

9. The wall-entry bathtub of claim 1, further comprising a drip tray and a drip tray water level sensor, wherein the controller is configured to close a drain valve if the drip tray water level sensor detect water.

10. The wall-entry bathtub of claim 1, wherein the first and second entry wall position sensors are selected from the group consisting of an electronic limit switch, a capacitive sensor, a pressure sensor, and an optical sensor.

11. A wall-entry bathtub, comprising:

a basin;

a shell defining an entryway to allow access into the basin;

an entry wall movable between a lowered position and a raised position, wherein the entry wall is substantially clear of the entryway in the lowered position and at least partially blocks the entryway in the raised position;

first and second entry wall position sensors configured to sense the position of the entry wall; and a controller in electronic communication with the first and second entry wall position sensors, wherein the controller is configured to control components of the bathtub based at least in part on the position of the entry wall;

wherein the seal member comprises a primary chamber and a secondary chamber.

12. The wall-entry bathtub of claim 11, further comprising a pressure sensor, wherein the controller is configured to monitor the pressure in the primary chamber using the pressure sensor.

13. The wall-entry bathtub of claim 11, wherein the controller is configured to provide a warning if the primary chamber fails to reach an operating pressure after a predetermined pressurization period.

14. A wall-entry bathtub, comprising:

a basin;

a shell defining an entryway to provide access into the basin;

an entry wall moveable between a lowered position and a raised position, wherein in the lowered position the entry wall is substantially clear of the entryway, and wherein in the raised position the entry wall at least partially blocks the entryway;

a seal member disposed generally between the entry wall and the shell, wherein the seal member is configured for inflation when the entry wall is in the raised position;

a pressure sensor configured to sense air pressure within the seal member; and a controller in electronic communication with the pressure sensor;

wherein the controller is configured to activate an alarm if the controller determines that the pressure in the seal member cannot be maintained within a pre-determined pressure range.

15. The wall-entry bathtub of claim 14, further comprising a compressor, wherein when the entry wall is in the raised position, the controller energizes the compressor to inflate the seal member, and wherein the controller de-energizes the compressor once the pressure sensor senses air pressure within a pre-determined range.

16. The wall-entry bathtub of claim 15, wherein the controller monitors the pressure in the seal member via the pressure sensor to ensure that the pressure in the seal member is maintained within the pre-determined pressure range, and wherein if the pressure within the seal member falls below the pre-determined pressure range, the controller energizes the compressor.

17. The wall-entry bathtub of claim 14, further comprising first and second entry wall position sensors that are configured to sense when the entry wall is in the raised or lowered position, wherein the controller is configured to close a drain valve when the first and second entry wall position sensors sense that the entry wall is in the raised position.

18. The wall-entry bathtub of claim 17, wherein the controller is configured to provide an alarm indicating an error condition if only one of the first and second entry wall position sensors sense that the entry wall is in the raised position.

19. The wall-entry bathtub of claim 14, further comprising a water supply valve and a basin water level sensor configured to sense a level of water below the entryway, wherein the controller is configured to close the water supply valve if the entry wall is in the raised position and the basin water level sensor senses a level of water.

20. The wall-entry bathtub of claim 14, further comprising a basin water level sensor configured to sense a level of water below the entryway, wherein the controller is configured to prevent the seal member from being deflated if water is detected in the basin by the basin water level sensor.

21. The wall-entry bathtub of claim 14, further comprising a drip tray and a drip tray water level sensor, wherein the controller is configured to open a drain valve if the controller determines that a water level in the drip tray has exceeded a desired level.

22. A wall-entry bathtub comprising a basin;

a shell defining an entryway to provide access into the basin;

an entry wall moveable between a lowered position and a raised position, wherein in the lowered position the entry wall is substantially clear of the entryway, and wherein in the raised position the entry wall at least partially blocks the entryway;

a seal member disposed generally between the entry wall and the shell, wherein the seal member is configured for inflation when the entry wall is in the raised position;

a pressure sensor configured to sense air pressure within the seal member;

a controller in electronic communication with the pressure sensor; and a flow controller;

wherein the seal member comprises a primary chamber and a secondary chamber;

wherein the flow controller is configured to divert pressurized air provided by a compressor between the primary chamber and the secondary chamber; and wherein the controller controls how the flow controller diverts air between the primary and secondary chambers.

23. The wall-entry bathtub of claim 22, wherein controller is configured to fully inflate the primary chamber to the pre-determined pressure range before inflating the secondary chamber.

24. The wall-entry bathtub of claim 22, wherein the controller is configured to direct the flow controller to inflate the primary and secondary chambers at the same time.

25. A wall-entry bathtub, comprising:

a basin;

a shell defining an entryway to provide access into the basin;

an entry wall movable between a lowered position in which the entry wall is substantially clear of the entryway and a raised position in which the entry wall at least partially blocks the entryway;

a controller configured to control components of the bathtub according to pre-determined logic stored in the controller;

first and second entry wall position sensors configured to sense the position of the entry wall; and a seal member disposed generally between the entry wall and the shell;

wherein the seal member is configured for inflation when the entry wall is in the raised position;

wherein the controller is configured to close a drain valve and inflate the seal member when the first and second entry wall position sensors sense that the entry wall is in the raised position; and wherein the controller is configured to provide a warning if the seal member fails to reach an operating pressure after a predetermined pressurization period.

26. The wall-entry bathtub of claim 25, wherein the controller is configured to inflate the seal member prior to closing the drain valve.

27. The wall-entry bathtub of claim 25, further comprising a pressure sensor configured to sense air pressure within the seal member, wherein the controller is configured to monitor the pressure in seal member.

28. The wall-entry bathtub of claim 25, further comprising a water supply valve and a basin water level sensor configured to sense a level of water below the entryway, wherein the controller is configured to close the water supply valve if the entry wall is in the raised position and the basin water level sensor senses a level of water.

29. The wall-entry bathtub of claim 28, wherein the controller is configured to prevent the seal member from being deflated if water is detected in the basin by the basin water level sensor.

30. The wall-entry bathtub of claim 25, further comprising a drip tray and a drip tray water level sensor, wherein the controller is configured to operate a drain valve if the controller determines that a water level in the drip tray has exceeded a desired level.

* * * * *